US010603572B2

(12) United States Patent
Riordan et al.

(10) Patent No.: US 10,603,572 B2
(45) **Date of Patent: *Mar. 31, 2020**

(54) MULTI-DECK AUTOMATIC CARD SHUFFLER CONFIGURED TO SHUFFLE CARDS FOR A CASINO TABLE GAME CARD GAME SUCH AS BACCARAT

(71) Applicant: Shark Trap Gaming & Security Systems, LLC, Las Vegas, NV (US)

(72) Inventors: Michael Earnest Riordan, Las Vegas, NV (US); Louis Wilson DeGregorio, Las Vegas, NV (US); Dino Louis DeGregorio, Las Vegas, NV (US); Steven Louis Forte, Las Vegas, NV (US); Westley Thomas Davis, Henderson, NV (US); Zachary Joesph Cook, Las Vegas, NV (US); Joseph William Riesen, Henderson, NV (US); Brendan John O'Toole, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/909,865

(22) Filed: Mar. 1, 2018

(65) Prior Publication Data

US 2018/0200610 A1 Jul. 19, 2018

Related U.S. Application Data

(63) Continuation of application No. 15/371,125, filed on Dec. 6, 2016, now Pat. No. 10,092,820, which is a (Continued)

(51) Int. Cl.
*A63F 1/12* (2006.01)
*A63F 1/00* (2006.01)

(Continued)

(52) U.S. Cl.
CPC ..... *A63F 1/12* (2013.01); *A63F 1/00* (2013.01); *A63F 1/14* (2013.01); *A63F 11/0002* (2013.01);

(Continued)

(58) Field of Classification Search
CPC ..... A63F 1/12; A63F 1/14; A63F 2250/58; A63F 11/0002

(Continued)

(56) References Cited

U.S. PATENT DOCUMENTS 5,000,453 A 3/1991 Stevens et al.
5,692,748 A 12/1997 Frisco et al.

(Continued)

FOREIGN PATENT DOCUMENTS

WO 9604969 A1 2/1996

OTHER PUBLICATIONS

Supplementary EP Search Report dated Mar. 18, 2019, 8 pages.

*Primary Examiner* — Benjamin Layno
(74) *Attorney, Agent, or Firm* — FisherBroyles, LLP; Rob L. Phillips

(57) ABSTRACT

An automatic card shuffler to shuffle eight decks of cards (or less) and deal a round of Baccarat. The automatic shuffler comprises two pre-shuffle bins, each receiving approximately four decks of cards wherein the pre-shuffle bins are spaced apart from one another with card slides directing to a card-receiving area. Cards are randomly selected from the cards in each of the pre-shuffle bins and propelled onto the card slides directing the cards to the card-receiving area. Once a sufficient number of buffer cards (e.g., seven) have been deposited into the card-receiving area, a card flipper moves the seven cards against a face plate of an integral dealing shoe. A buffer-holder member maintains the buffer cards against the face plate for dealing as the card flipper (Continued)

returns to a home position to receive more shuffled cards while buffer cards are being dealt in a round of Baccarat.

18 Claims, 41 Drawing Sheets

Related U.S. Application Data continuation-in-part of application No. 15/145,192, filed on May 3, 2016, now Pat. No. 9,573,047.

(51) Int. Cl.
*A63F 11/00* (2006.01)
*A63F 1/14* (2006.01)

(52) U.S. Cl.
CPC ..... *A63F 2001/001* (2013.01); *A63F 2250/58* (2013.01)

(58) Field of Classification Search
USPC ..... 273/149 R, 149 P; 463/22
See application file for complete search history.

(56) References Cited

U.S. PATENT DOCUMENTS

| | | | | |
|---|---|---|---|---|
| 9,873,034 | B2 * | 1/2018 | Riordan | A63F 1/14 |
| 2009/0072477 | A1 | 3/2009 | Tseng | |
| 2014/0027979 | A1 | 1/2014 | Stasson | |
| 2016/0082344 | A1 | 3/2016 | Kelly et al. | |

* cited by examiner

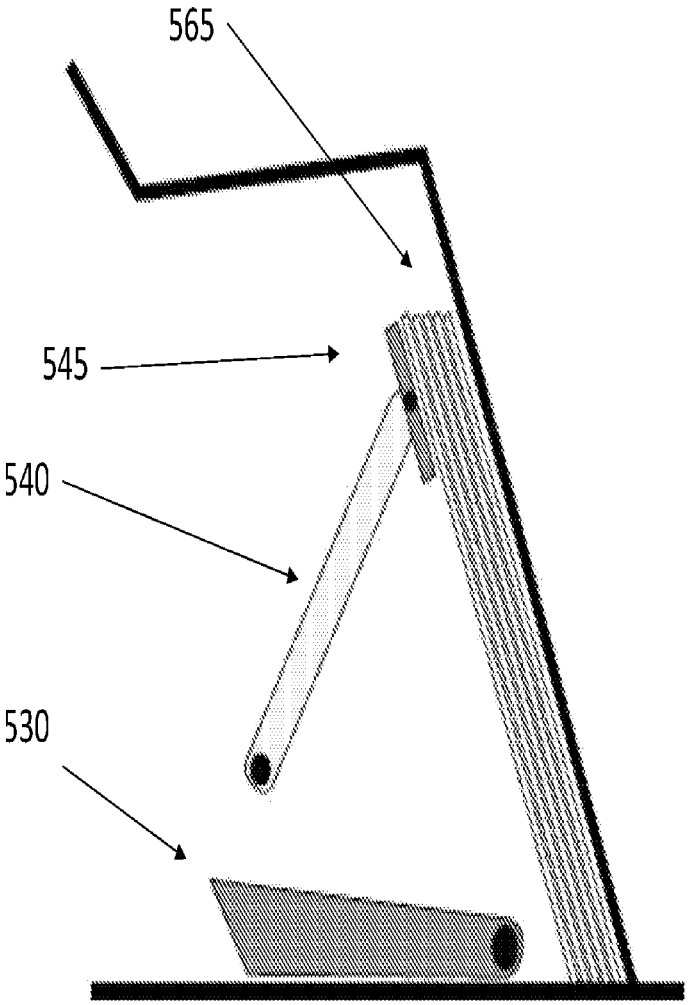
565
545
540
530

MULTI-DECK AUTOMATIC CARD SHUFFLER CONFIGURED TO SHUFFLE CARDS FOR A CASINO TABLE GAME CARD GAME SUCH AS BACCARAT

CROSS-REFERENCE

This application is a continuation of U.S. patent application Ser. No. 15/371,125 filed Dec. 6, 2016, now U.S. Pat. No. 10,092,820, which is a continuation-in-part of U.S. patent application Ser. No. 15/145,492 filed May 3, 2016, now U.S. Pat. No. 9,573,047, both of which are incorporated herein by reference for any and all purposes.

FIELD OF THE INVENTION

The embodiments of the present invention relate to an automatic card shuffler for use with card games utilizing 4-6 decks of cards such as Baccarat.

BACKGROUND

Automatic card shufflers have been used by casinos for decades and have helped revolutionize the gaming industry. Automatic card shufflers speed up play of casino games and may reduce cheating and advantage play. Automated shufflers may be configured to sit on a casino table or be incorporated therein.

The automatic shuffler industry is currently dominated by automatic shufflers which utilize rollers, elevators and bins to separate and randomly reorganize the cards. It would be advantageous to develop new automatic shuffler technology which is more efficient and reliable than the current automatic shuffler technology.

SUMMARY

A first embodiment of the present invention relates to a single deck shuffler utilized for poker games. Those skilled in the art will recognize that the shuffler technology disclosed herein may be used with multi-deck shufflers and other card games as well.

Accordingly, one embodiment of the automatic card shuffler of the present invention comprises broadly a pre-shuffle bin, card-selector assembly, drive wheel and post-shuffle bin. The pre-shuffle bin is configured to accept a single deck of cards (e.g., standard 52-card deck of playing cards). While in the pre-shuffle bin, a modest downward force may be applied to the single deck of cards. A weight, spring, roller or other physical article may be used to apply the modest downward force. Modest as used herein means a force that maintains the deck of cards substantially flat and square during the shuffling process. Any weight or other article in contact with the cards should have a soft padding between the weight or other article and the cards to prevent damage to the cards. A base or floor of the pre-shuffle bin is an independent member that may be selectively raised and lowered to position the deck of cards pursuant to a randomly-selected card number (e.g., 1-52). Two jokers may also be used such that a deck of playing cards includes 54 playing cards rather than 52. Once positioned correctly based on the randomly-selected card number, an upper body of the card-selector assembly moves a number of cards corresponding to the randomly-selected card number off the top of the deck thereby exposing a bottom card (i.e., the randomly-selected card) to a drive wheel. The drive wheel propels the bottom card from the pre-shuffle bin between offset lower and upper walls defining a passageway into the post-shuffle bin. The process is repeated 51 times until all cards in the deck in the pre-shuffle bin have been propelled into the post-shuffle bin.

Another embodiment of the present invention comprises an automatic card shuffler configured to shuffle eight decks of cards (or less) and deal a round of Baccarat. A round being a number of cards sufficient to deal a Baccarat hand in a traditional manner (i.e., one card at a time to each player position). In this embodiment, the automatic shuffler comprises two pre-shuffle bins, each configured to receive approximately four decks of cards wherein the pre-shuffle bins are spaced apart from one another, each near a card slide leading to a card-receiving area. Cards are randomly selected from the cards in each of the pre-shuffle bins and propelled against a respective card slide directing the cards to the card-receiving area where shuffled cards stack. Once a sufficient number of buffer cards (e.g., seven) have been deposited into the card-receiving area, a card flipper moves the seven cards against a face plate of an integral dealing shoe. A buffer-holder device maintains the buffer cards against the face plate for dealing as the card flipper returns to a home position to receive more shuffled cards. In this manner, while cards are being dealt in a round of Baccarat, new cards are being shuffled for the next round.

Other variations, embodiments and features of the present invention will become evident from the following detailed description, drawings and claims.

BRIEF DESCRIPTION OF THE DRAWINGS

FIGS. 19A-19M illustrate a cross-sectional view of a first embodiment of a Baccarat shuffler and buffer apparatus according to the embodiments of the present invention;

DETAILED DESCRIPTION

Figure 1:
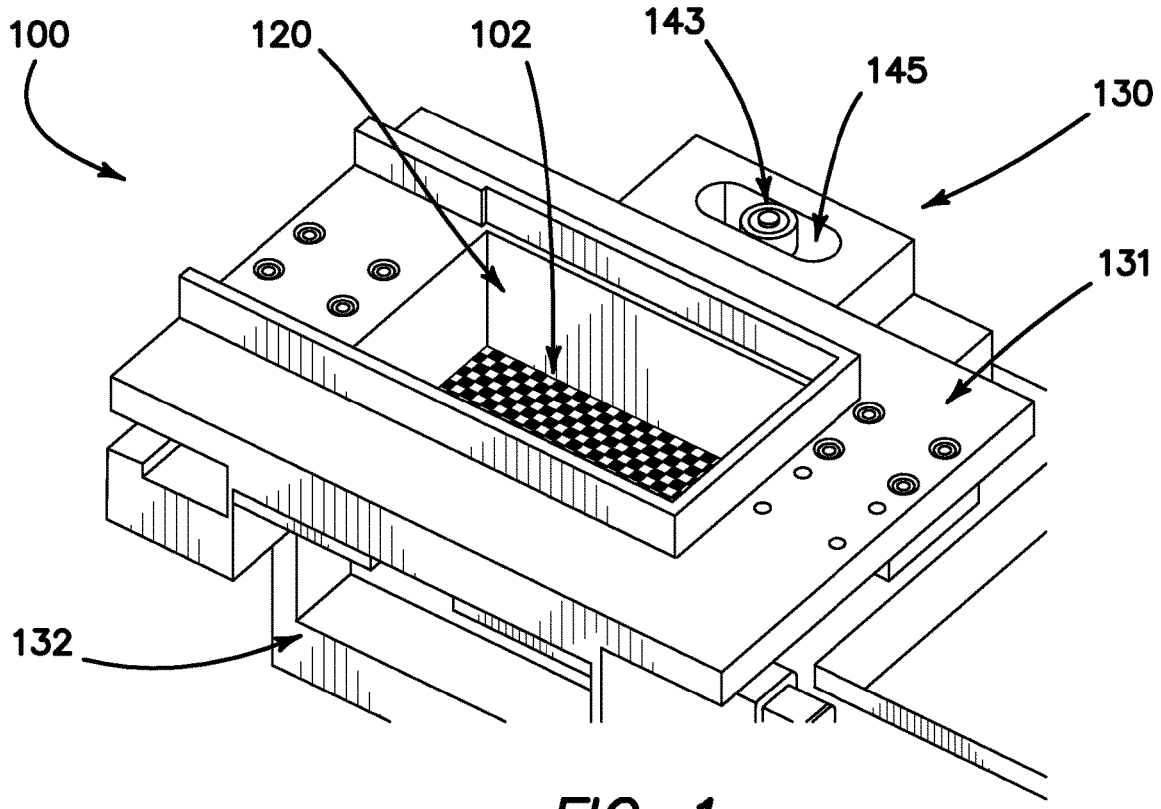
FIG. 1 illustrates a perspective upper view of an automatic card shuffler without a cover in place according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

As will be appreciated by one skilled in the art, the embodiments of the present invention combine software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

Computer program code for carrying out operations for embodiments of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The components of the embodiments of the present invention may be fabricated of any suitable materials, including, but not limited to, plastics, alloys, composites, resins and metals, and may be fabricated using suitable techniques, including, but not limited to, molding, casting, machining and rapid prototyping.

Detailed below is a single deck automatic card shuffler configured to insert into a poker table. In one embodiment, the single deck automatic card shuffler inserts into the chip tray cut-out in the poker table proximate to the poker game dealer. Those skilled in the art will recognize that the shuffler technology disclosed herein may be used with multi-deck shufflers which insert into a gaming table or secure to a gaming table top or bottom. The automatic card shuffler may be used to shuffle paper and plastic cards.

The single deck shuffler detailed herein comprises broadly a (i) pre-shuffle bin, (ii) card-selector assembly, (iii) drive wheel and (iv) post-shuffle bin. FIG. 1 illustrates a perspective upper view of the single deck shuffler 100 with the pre-shuffle bin 120 loaded with a deck of cards 102. In practice, a housing or cover may conceal the internal components of the automatic shuffler 100. The pre-shuffle bin 120 forms part of the card-selector assembly 130. Not shown in FIG. 1 is an optional article for creating a modest downward force of the deck of cards 102 to maintain said deck of cards 102 in a substantially flat and square orientation. FIGS. 8A through 11C show various articles of the type suitable to create the modest downward force on the deck of cards 102 in the pre-shuffle bin 120.

Figure 8A:
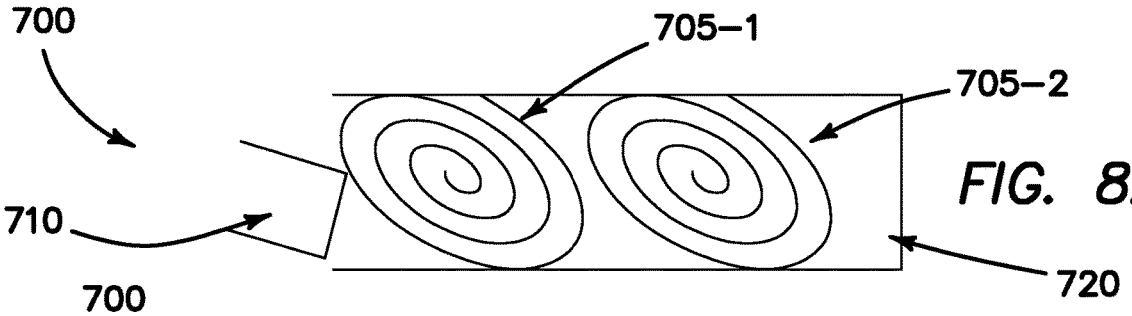
FIGS. 8A-8C illustrate a spring assembly for applying a modest downward force on a deck of cards in the pre-shuffle bin according to the embodiments of the present invention.
Figure 8B:
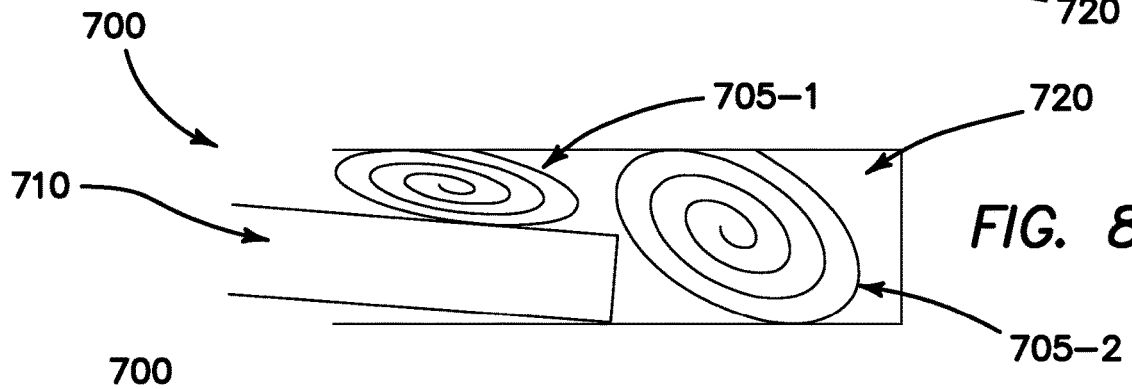
Figure 8C:
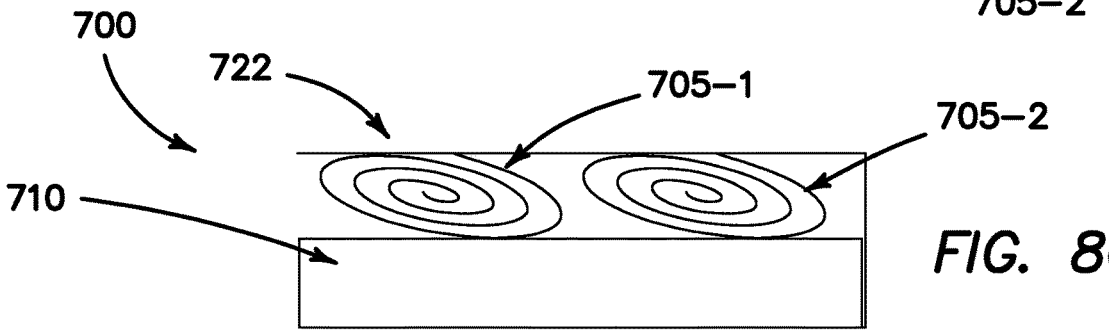

FIGS. 8A-8C show a spring assembly 700 for applying a modest downward force on a deck of cards 710 in the pre-shuffle bin 720 according to the embodiments of the present invention. A pair of clock springs 705-1 and 705-2 joined to a pre-shuffle bin cover, lid or top 722 compresses upward as the deck of cards 710 is inserted horizontally into the pre-shuffle bin 720. In the coressed state, the clock springs 705-1 and 705-2 apply a modest downward force on the deck of cards 710 thereby maintaining the deck of cards 710 in a substantially flat and square orientation.

Figure 9A:
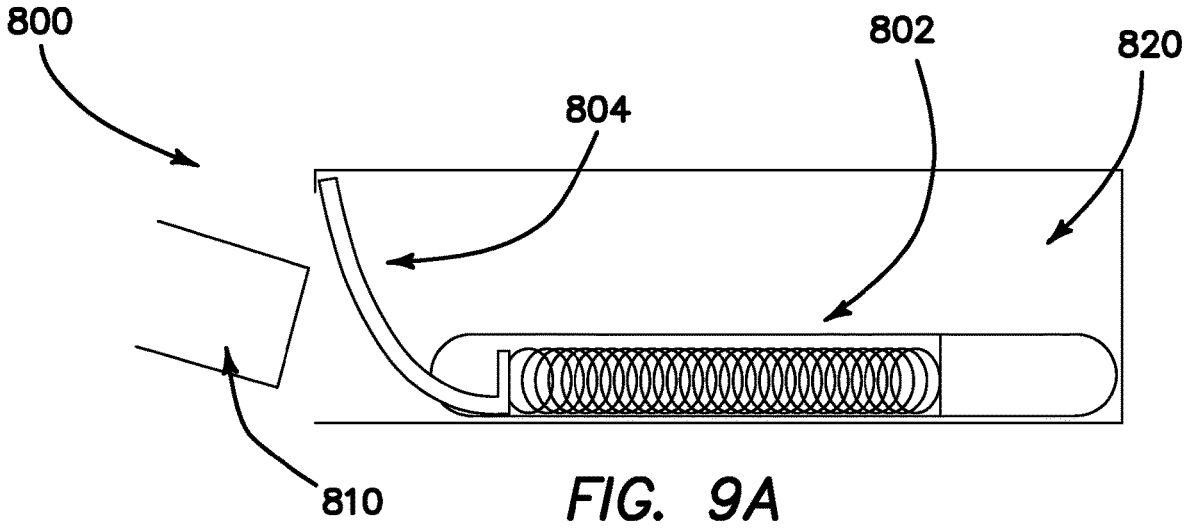
FIGS. 9A-9C illustrate an independent weight assembly for applying a modest downward force on a deck of cards in the pre-shuffle bin according to the embodiments of the present invention.
Figure 9B:
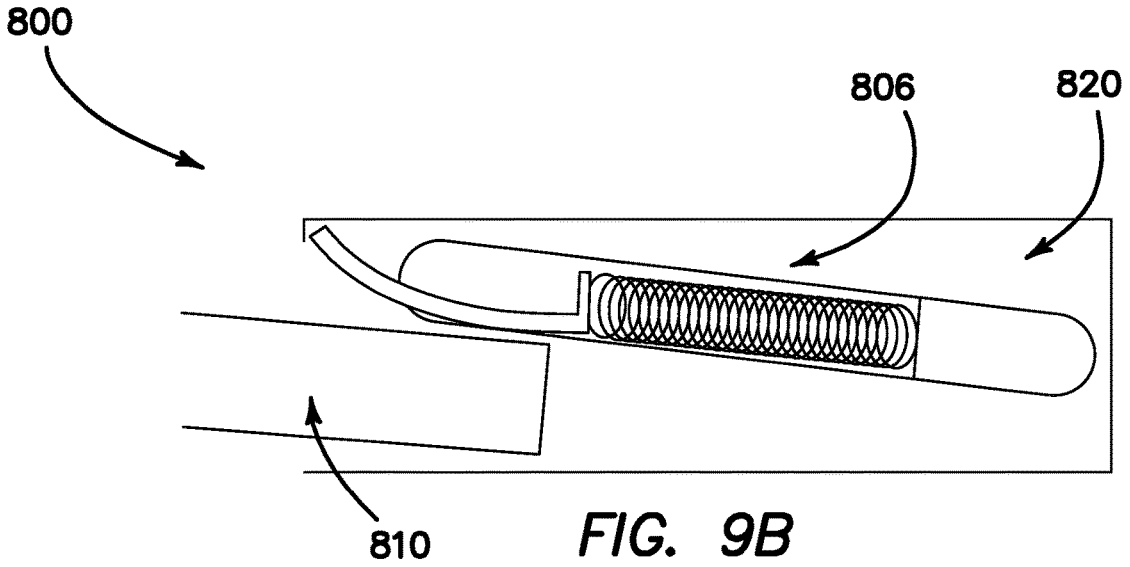
Figure 9C:
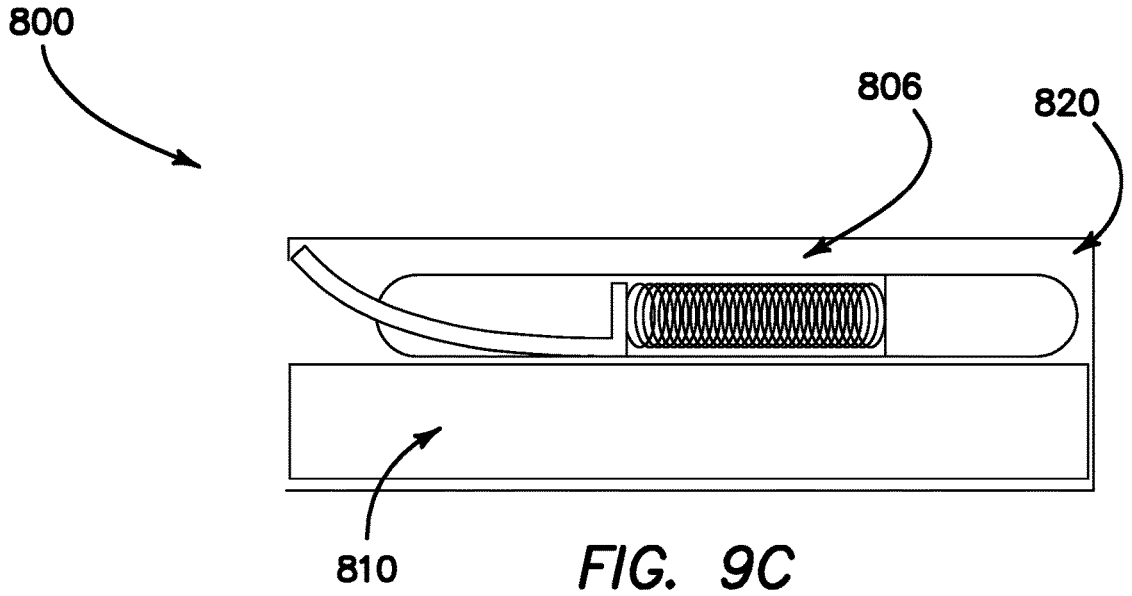

FIGS. 9A-9C show an independent weight assembly 800 for applying a modest downward force on a deck of cards 810 in the pre-shuffle bin 820 according to the embodiments of the present invention. The independent weight assembly 800 comprises a weight 802, guiding member 804 and internal spring 806. As the deck of cards 810 is inserted horizontally into the pre-shuffle bin 820, the guide member 804 elevates compressing internal spring 806 raising the weight 802 on top of the deck of cards 810.

Figure 10A:
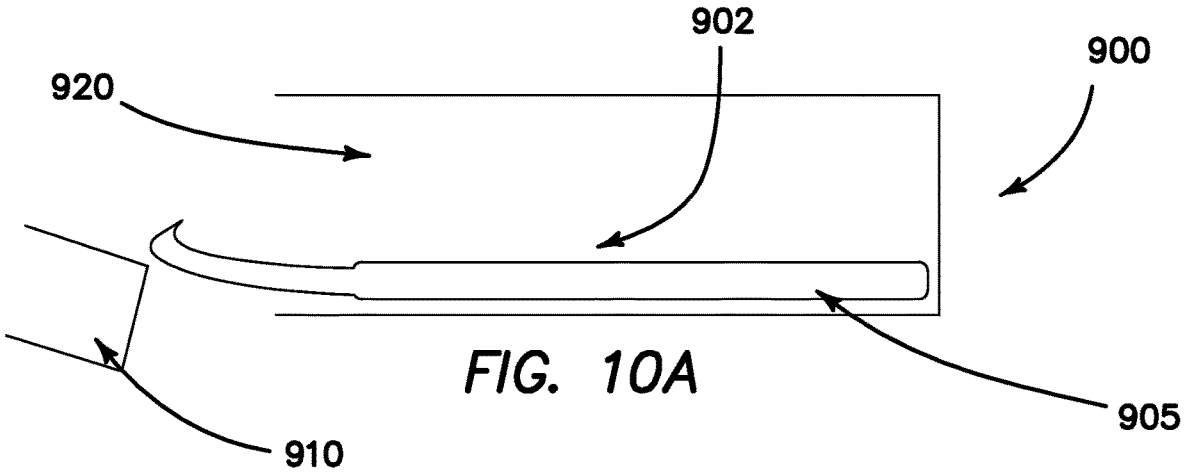
FIGS. 10A-10C illustrate a weighted lever for applying a modest downward force on a deck of cards in the pre-shuffle bin according to the embodiments of the present invention.
Figure 10B:
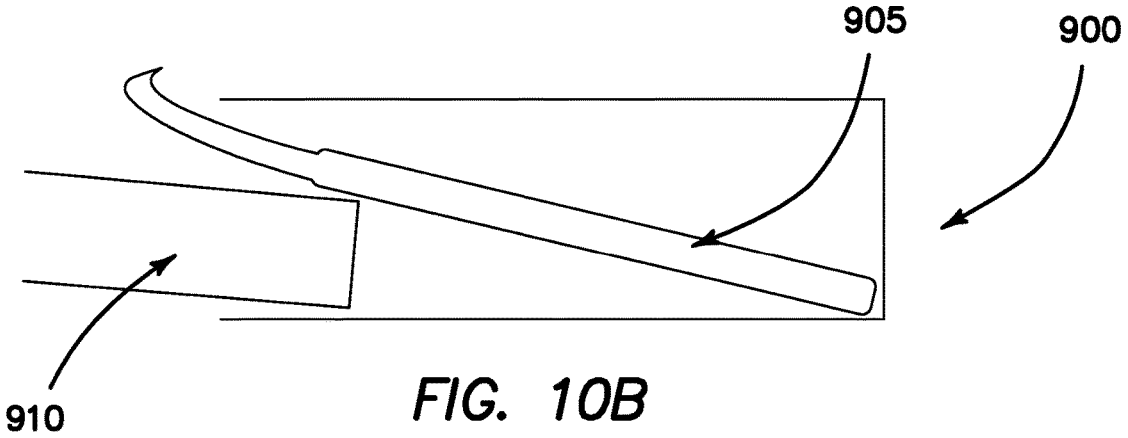
Figure 10C:
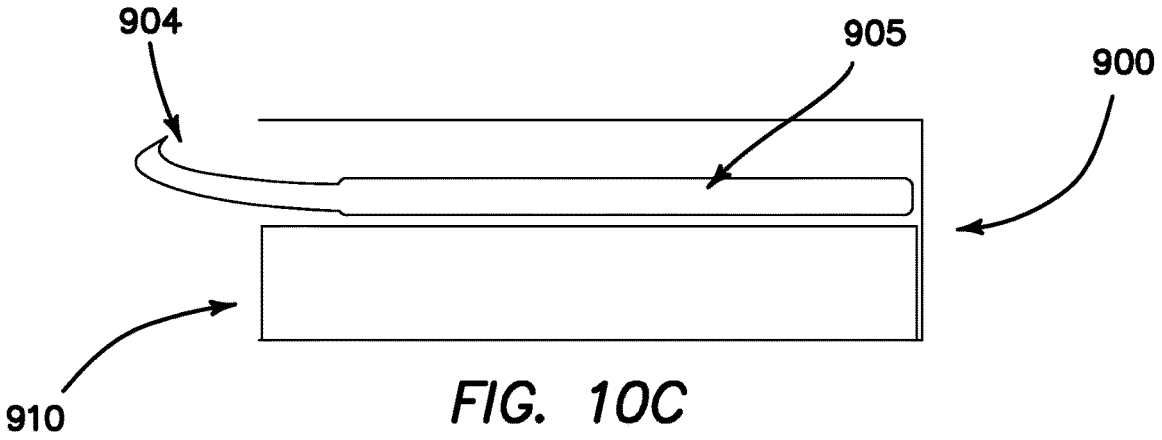

FIGS. 10A-10C show a weighted lever system 900 for applying a modest downward force to a deck of cards 910 in the pre-shuffle bin 920 according to the embodiments of the present invention. The weighted lever 905 is shaped with a flat first portion 902 and upwardly curved second portion 904 permitting the deck of cards 910 to slide horizontally under the weighted lever 900. As shown, the weighted lever 900 is not attached in any manner. Alternatively, one end of the weighted lever 900 may be slidably joined to a wall of the pre-shuffle bin 920.

Figure 11A:
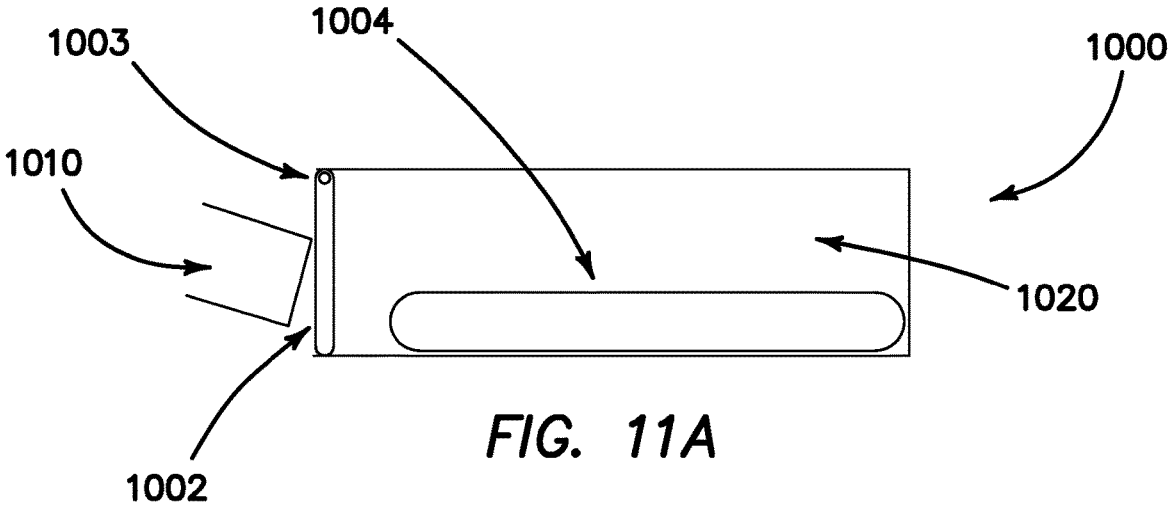
FIGS. 11A-11C illustrate an independent weight and door assembly for applying a modest downward force on a deck of cards in the pre-shuffle bin according to the embodiments of the present invention.
Figure 11B:
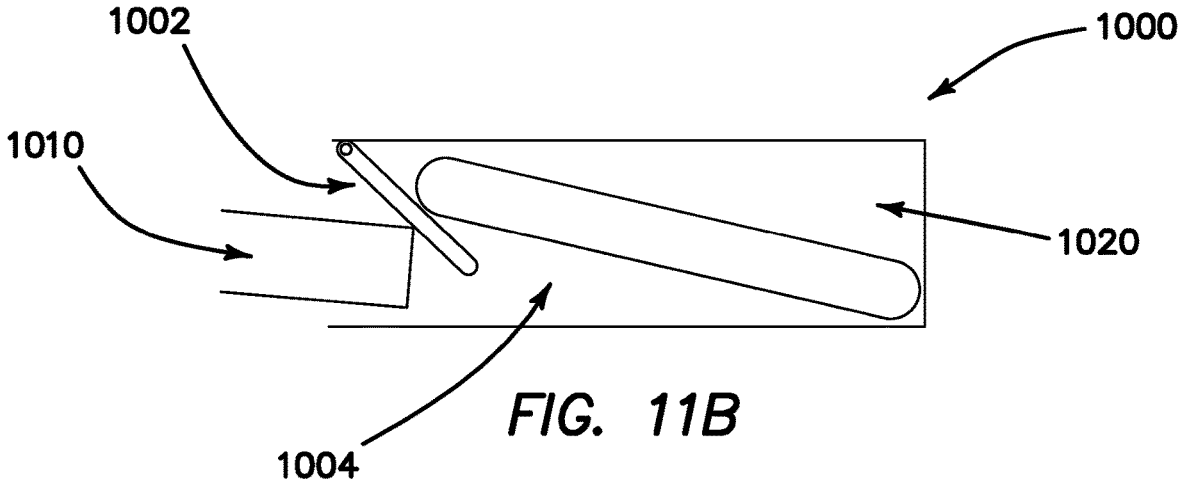
Figure 11C:
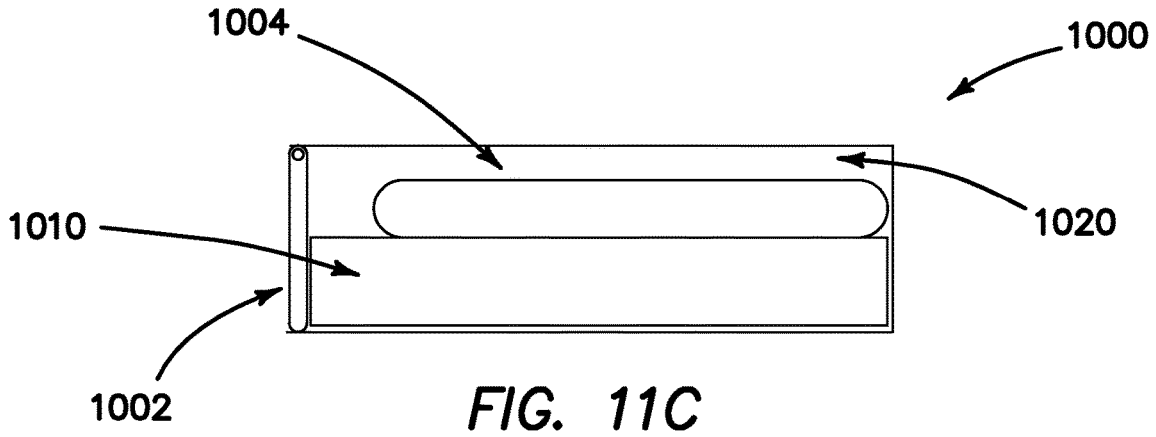

FIGS. 11A-11C show an independent weight and door assembly 1000 for applying a modest downward force on a deck of cards 1010 in the pre-shuffle bin 1020 according to the embodiments of the present invention. The independent weight and door assembly 1000 comprises a rotatable door 1002 and independent weight 1004. In operation, as the deck of cards 1010 is inserted horizontally into the pre-shuffle bin 1020, the door 1002 rotates about an upper rotation point 1003 such that the door 1002 lifts one end of the independent weight 1004 allowing the deck of cards to be inserted under the independent weight 1004.

While FIGS. 8A-11C show various solutions for applying a downward force on a deck of cards while in the pre-shuffle bin 102, those skilled in the art will recognize that other articles may suffice. In addition, electromechanical devices may be used as well. For example, idler rollers may be pushed downward on a deck of cards to apply the downward force.

Figure 2:
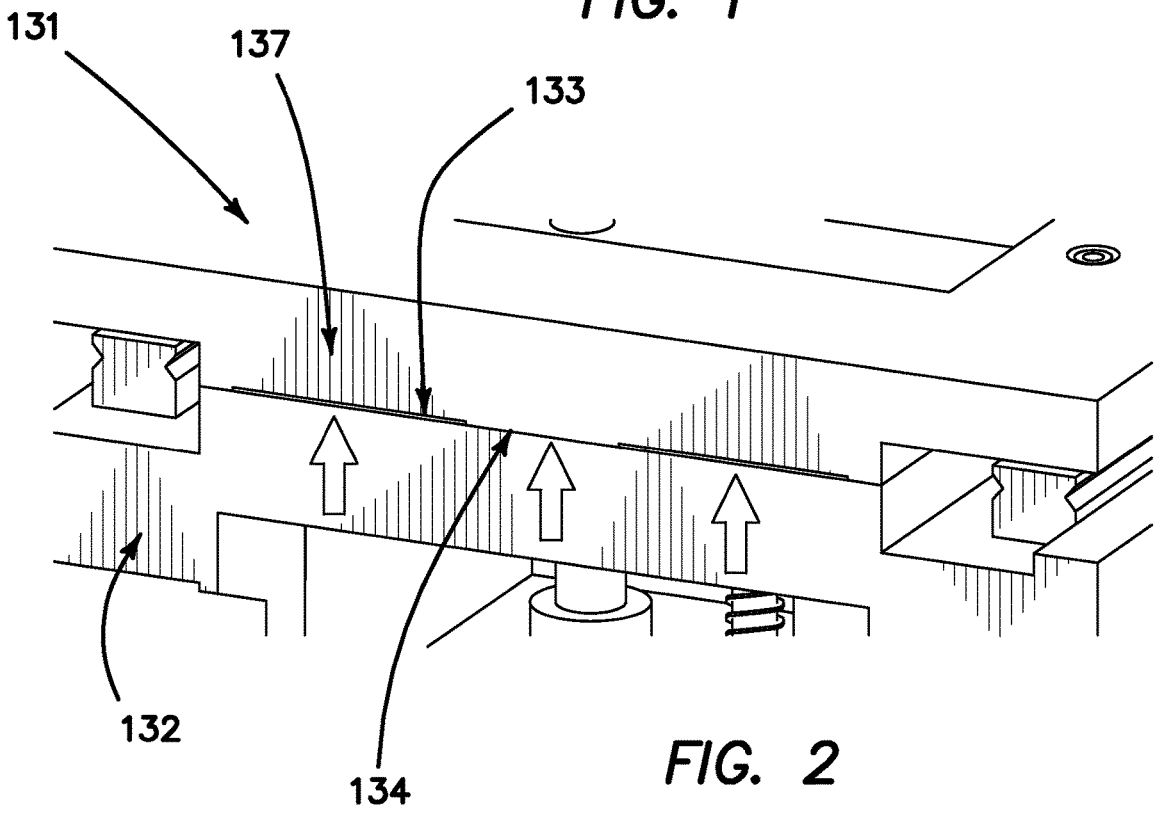
FIG. 2 illustrates a front view of a card-selector assembly of the automatic card shuffler according to the embodiments of the present invention.

FIG. 2 shows a side view of a card-selector assembly 130 of the automatic card shuffler 100 according to the embodiments of the present invention. The card-selector assembly 130 comprises the upper body 131 and lower body 132. The lower body 132 is stationary. The upper body 131 interconnects to the lower body 132 via a linear groove allowing the upper body 131 to slide on the lower body 132 via series of ball bearings. The lower body 132 and upper body 131, when aligned, define a gap 133 between walls thereof. A center notch 134 provides a location for drive wheel 160 or other drive mechanism to propel an exposed card as described below. When the upper body 131 and lower body 132 are aligned, the stepper motor 124 may raise and lower the pre-shuffle bin base 122. When the upper body 131 and lower body 132 are not aligned, the stepper motor 124 is not able to raise and lower the pre-shuffle bin base 122.

The base or floor 122 of the pre-shuffle bin 120 is free to raise and lower relative to an upper body 131 and lower body 132 of the card-selector assembly 130 thereby selectively positioning the deck of cards 102 into 1 of at least 52 vertical positions. In one embodiment, best seen in FIGS. 7B and 7C, a stepper motor 124 controls the selective positioning of the pre-shuffle bin base 122. A random number generator 126 in communication with the stepper motor 124 transmits instructions to the stepper motor 124 based on a randomly-generated number from 1 to 52 (or some other set of numbers capable of generating 52 random positions).

Figure 3:
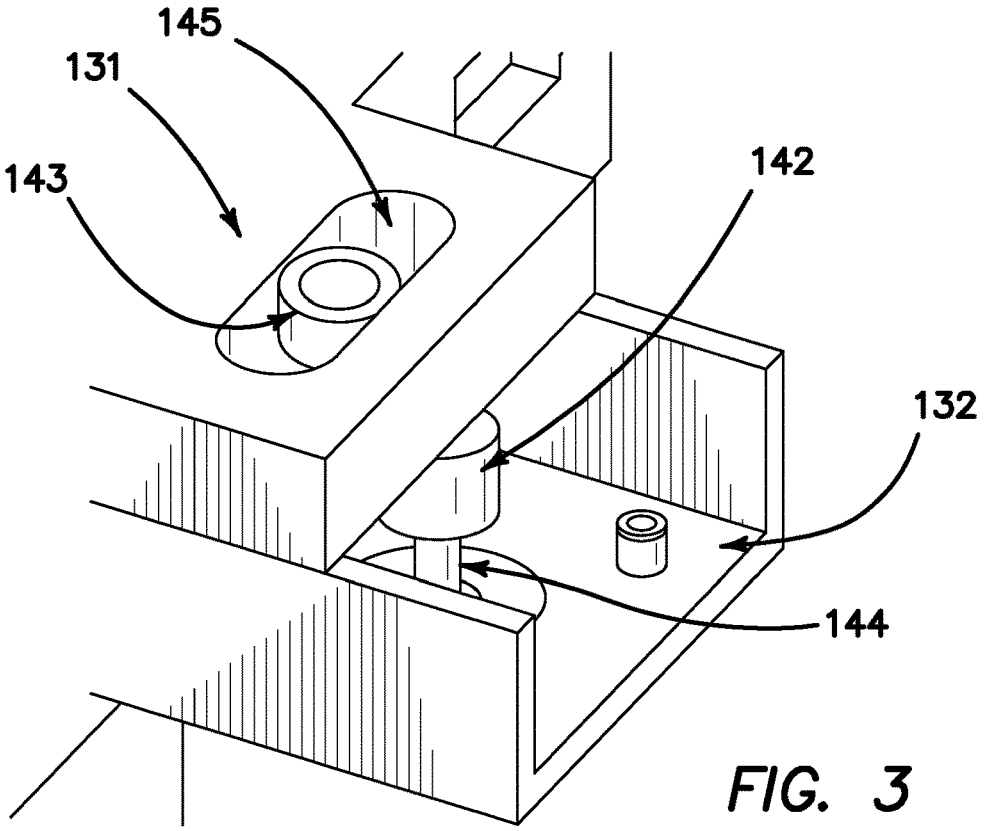
FIG. 3 illustrates an offset idler wheel of the card-selector assembly of the automatic card shuffler according to the embodiments of the present invention.
Figure 4:
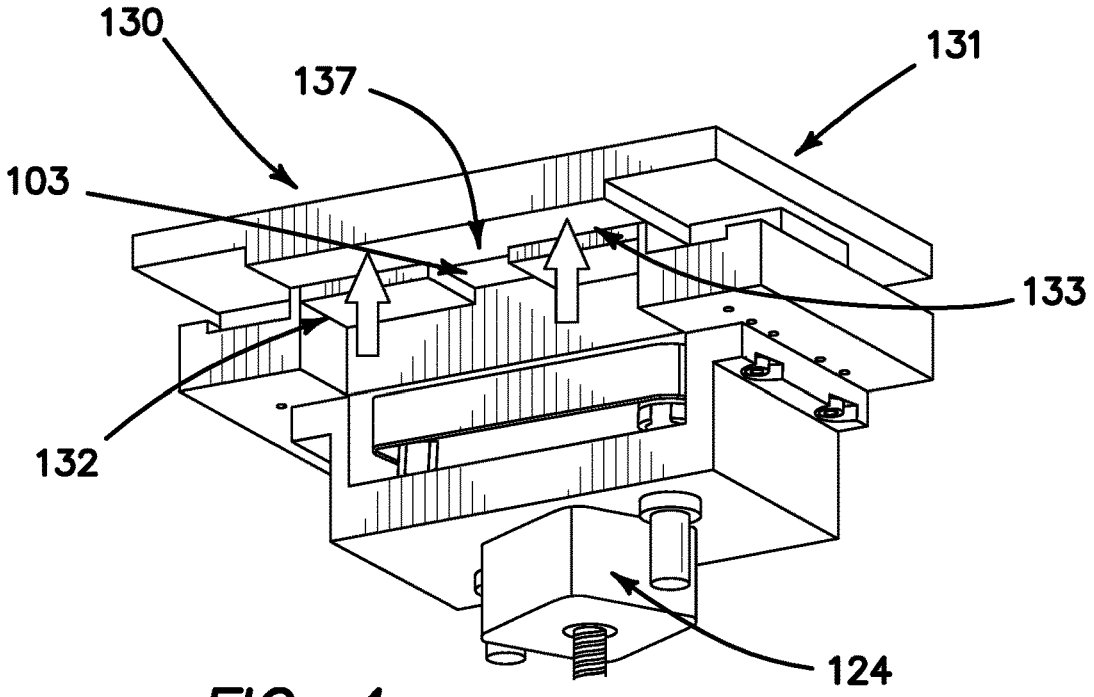
FIG. 4 illustrates an upper body of the card-selector assembly in a forward position according to the embodiments of the present invention.

FIG. 3 shows an offset idler wheel 142 of the card-selector assembly 130 according to the embodiments of the present invention. The offset idler wheel 142 is mounted to a vertical shaft 144 extending from said lower body 132 and driven by motor 110. The offset idler wheel 142 rotates an offset, attached secondary wheel 143 within a cam slot 145 in the upper body 131. Activation of the offset idler wheel 142 causes the secondary wheel 143 to force the upper body 131 to slide forward and rearward relative to the lower body 132 as needed. FIG. 4 shows the upper body 131 of the card-selector assembly 130 in a forward position.

Figure 5:
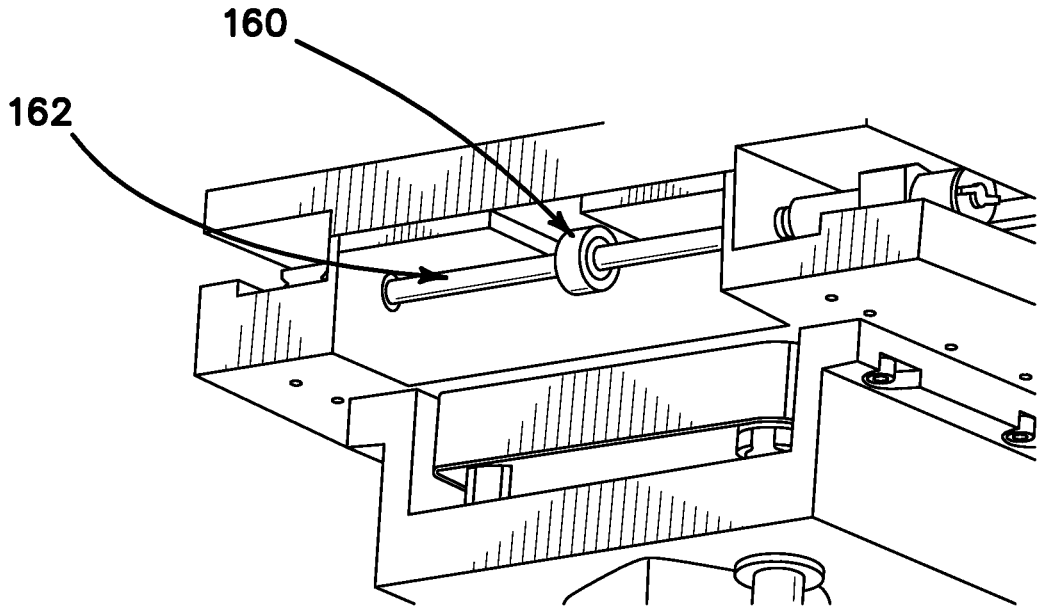
FIG. 5 illustrates a drive wheel relative to the card-selector assembly according to the embodiments of the present invention.
Figure 6B:
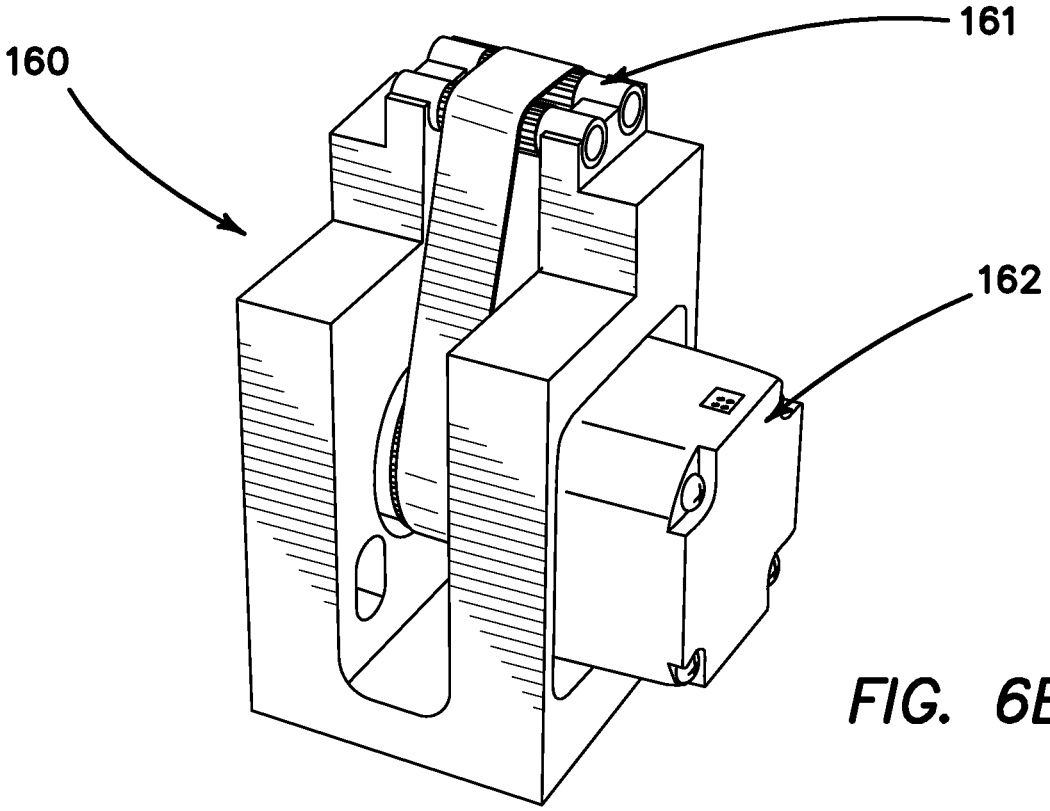
FIGS. 6A and 6B illustrates a cross-sectional view of the automatic card shuffler and drive mechanism, respectively, according to the embodiments of the present invention.
Figure 6A:
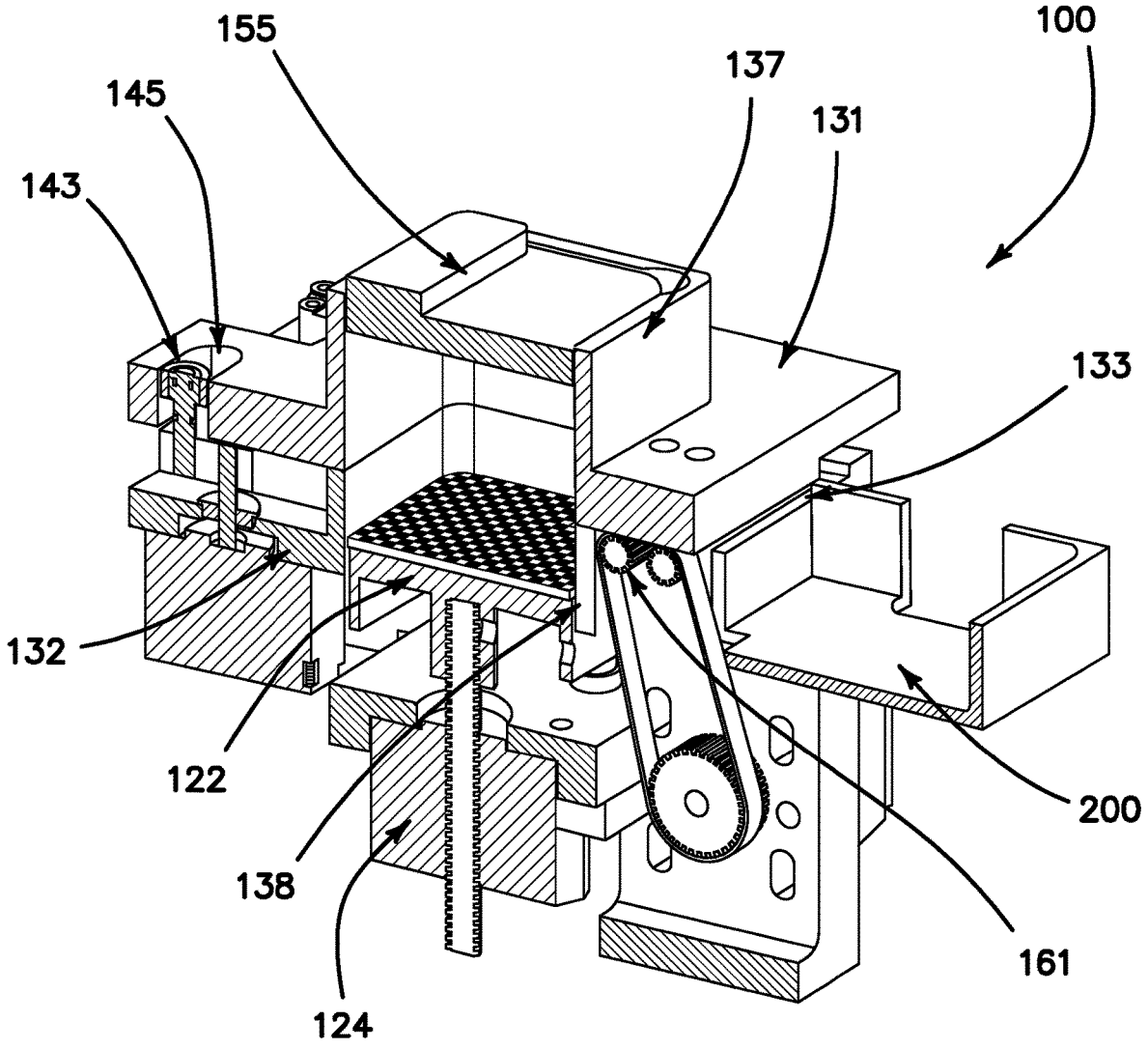

As seen in FIG. 4, when the upper body 131 moves forward, a card 103 is exposed in cut-out 104 in the lower body 132. The exposed card 103 may then be contacted by a drive wheel 160 mounted on a rotatable rod 162 shown in FIG. 5. As the upper body 131 moves forward, the upper body 131 serves to split the cards in the pre-shuffle bin 120 into an offset upper portion and lower portion with the bottom card of the offset portion being the card identified by the random number generator. The spinning drive wheel 160 contacting the exposed card 103 causes the exposed card 103 to be propelled to the post-shuffle bin 200. Once each of the 52 cards in the deck of cards has been propelled to the post-shuffle bin 200, the deck of cards is shuffled and available for play. FIG. 6A shows a cross-sectional view of the shuffler 100. In this embodiment, a weight 155 is positioned to apply a downward force to a deck of cards to be shuffled. Rather than a drive wheel 160, the drive mechanism (as shown in FIG. 6B) for propelling cards into the post-shuffle bin 200 is a belt and pulley arrangement 161 driven by motor 162.

Figure 13:
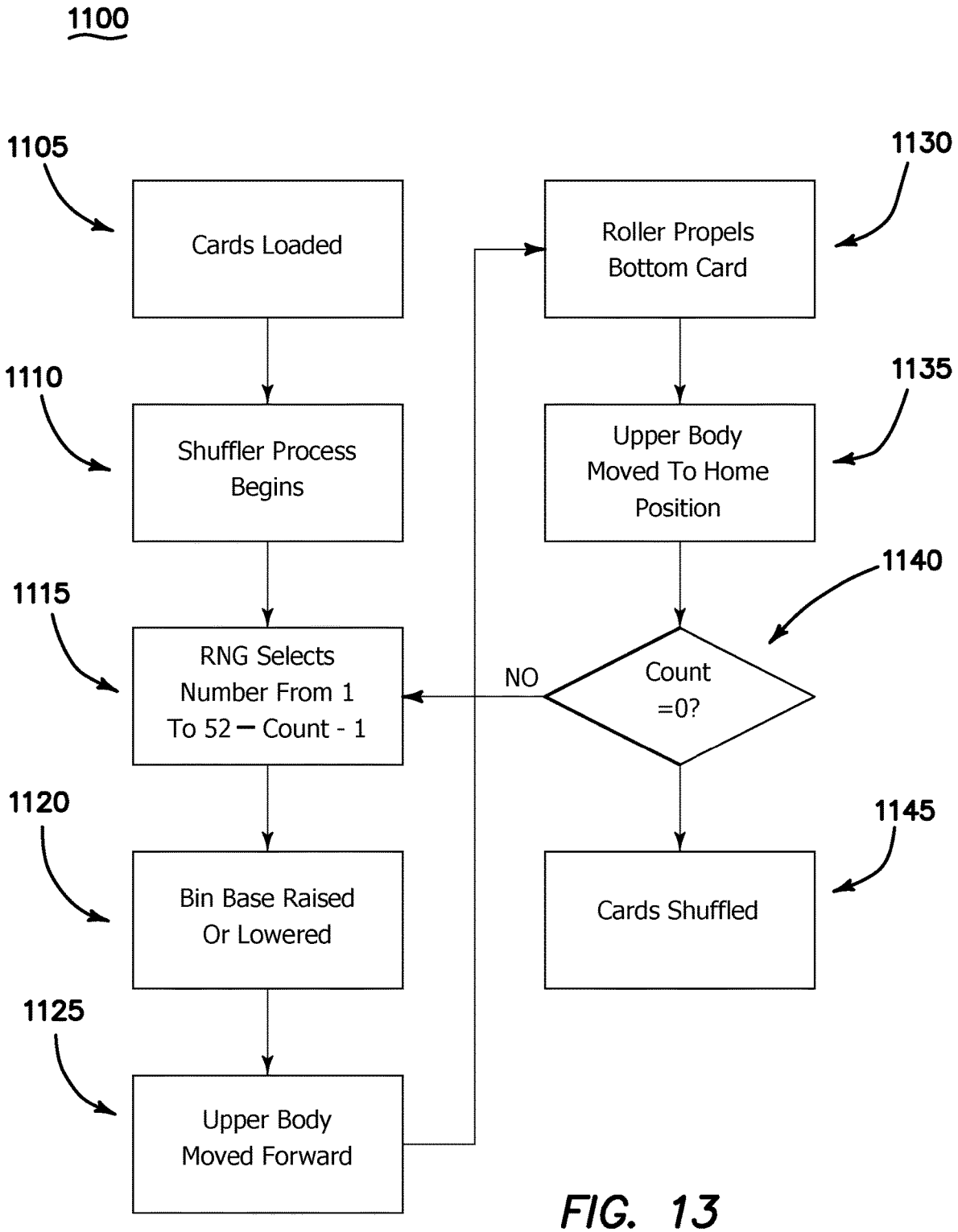
FIG. 13 illustrates a flow chart detailing one methodology for operating the automatic card shuffler according to the embodiments of the present invention.

FIG. 13 shows a flow chart 1100 detailing one methodology for operating the automatic card shuffler 100 according to the embodiments of the present invention. At 1100, a deck of cards is inserted into the pre-shuffle bin 120. The cards may be loaded via a top, back or side opening in a cover or housing of the shuffler 100. A sensor-controlled door for the pre-shuffle bin 120 may remain closed until all cards have been moved into the post-shuffle bin 200. As detailed above, in one embodiment, an article is used to apply a downward force on the deck of cards in the pre-shuffle bin. At 1110, upon detection by one or more sensors 104, 105 proximate to the pre-shuffle bin 120 and post-shuffle bin 200, respectively, indicating cards in the pre-shuffle bin 120 and no cards in the post-shuffle bin 200, the automatic shuffler 100 begins the shuffling process. In one embodiment, the shuffle process starts after a short delay (e.g., 2 seconds). At 1115, a random number generator selects a card number from 1 to 52 such that the corresponding card is propelled into the post-shuffle bin 200 and then the total number of remaining cards is reduced by one for the purpose of randomly selecting and shuffling the next card. The random number generator is software-based and in one embodiment uses a Fischer-Yates model to randomly select the card number. The card number is counted from the top of the deck of cards. For example, card number 23 is the 23$^{rd}$ card from the top of the deck of cards. In an alternative embodiment, the card number may be counted from the bottom of the deck of cards. Once the card number is randomly selected, at 1120, the pre-shuffle bin base 122 is raised or lowered by stepper motor 124 to align the selected card with the gap 133. For example, if the first card number is 23, the pre-shuffle bin base 122 is moved so that the 23$^{rd}$ card from the top of the deck of cards is aligned with the gap 133. At 1125, the upper body 131 moves forward thereby forcing the top 23 cards off the deck of cards in the pre-shuffle bin 120 slightly forward relative to and offset from to the pre-shuffle bin 120 and cards therein. The stationary lower body 123 prevents any card below the 23$^{rd}$ card in the deck of cards from moving forward with the upper body 131. The 23$^{rd}$ card is the bottom card of the stack of cards moved forward by the upper body 131. The other 29 cards in the deck of cards remain in the pre-shuffle bin 120 below and not impacted by the moving upper body 131. At 1130, once the 23 cards are moved a maximum distance (e.g., one inch offset relative to the lower body 132), the spinning drive wheel 160 contacts the bottom card (i.e., the 23$^{rd}$ card) propelling it to the post-shuffle bin 200. The drive wheel 160 may be positioned to contact the exposed bottom card when the card is moved forward or the drive wheel 160 may selectively raise to contact the exposed bottom card as the card is forced forward by the upper body 131. More than one drive wheel may be used including vertically-oriented rollers to provide additional energy to propel cards from the pre-shuffle bin 120 to the post-shuffle bin 200. Blocking wall 137 of upper body 131 and wall 138 of the lower body 132 collectively allow only the bottom card of the offset upper portion of cards to be propelled into the post-shuffle bin 200 by the drive wheel 160. The blocking wall 137 is dimensioned to block all cards above the selected card while permitting the selected bottom card to be contacted by the drive mechanism. At 1135, once the exposed bottom card is propelled to the post-shuffle bin 200, the upper body 131 moves rearward depositing the offset upper portion of cards, minus the propelled card, back into the pre-shuffle bin 120 on top of the cards remaining in the pre-shuffle bin 120. At 1140, it is determined if the number from step 1115 equals zero meaning that all cards have been propelled to the post-shuffle bin 200. Moving each card into the post-shuffle bin 200 requires the automatic shuffler 100 to cycle 52 times (i.e., one cycle per card in the deck of cards). A cycle includes raising or lowering the pre-shuffle bin base 122 and moving the upper body 131 forward and rearward. If the current number representing cards remaining in the pre-shuffle bin 120 is not zero at 1135, the flow chart 1100 loops back to step 1115 where the random number generator selects a number between 1 and the current number or cards remaining. That is, each time a card is moved to the post-shuffle bin 200, the random number generator generates a random number based on the number of cards remaining to be moved into the post-shuffle bin 200. Once all cards have been moved to the post-shuffle bin 200, at 1145, the shuffled cards are accessed by the dealer for play of a game.

Figure 7A:
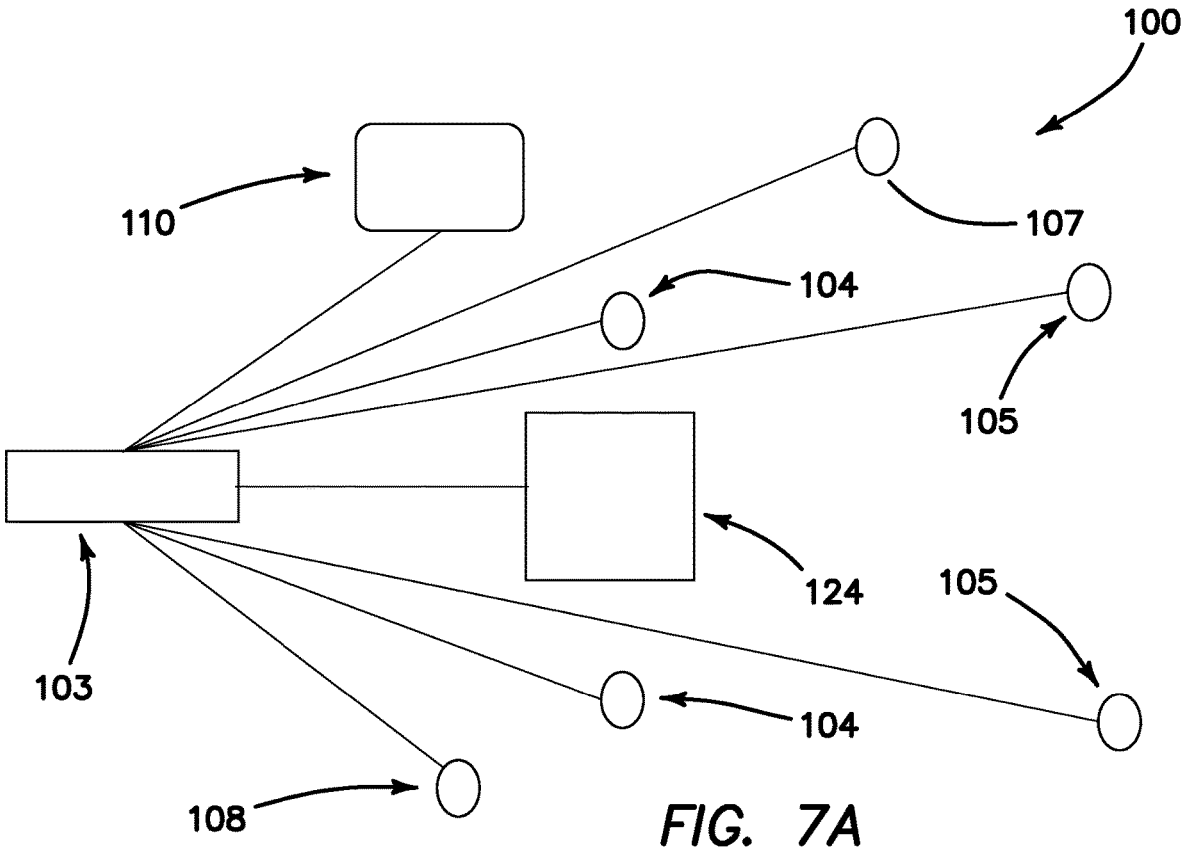
FIG. 7A illustrates a block diagram of a single deck card shuffler according to the embodiments of the present invention.

FIG. 7A shows a block diagram of the single deck shuffler 100. A controller, processor 103 or like runs executable instructions for controlling the operations of the single deck shuffler 100. The processor 103 communicates with hardware including: (i) sensors 104 located proximate to the pre-shuffle bin 120; (ii) sensors 105 located proximate to the post-shuffle bin 200; (iii) stepper motor 124 and (iv) motor 110 for driving the offset idler wheel 142. The processor 103 is further in communication with memory 107 and random number generator 108. The random number generator 108 may be part of the executable instructions or a separate module as shown. In one embodiment, the single deck shuffler 100 is approximately 400 in$^3$.

Figure 7B:
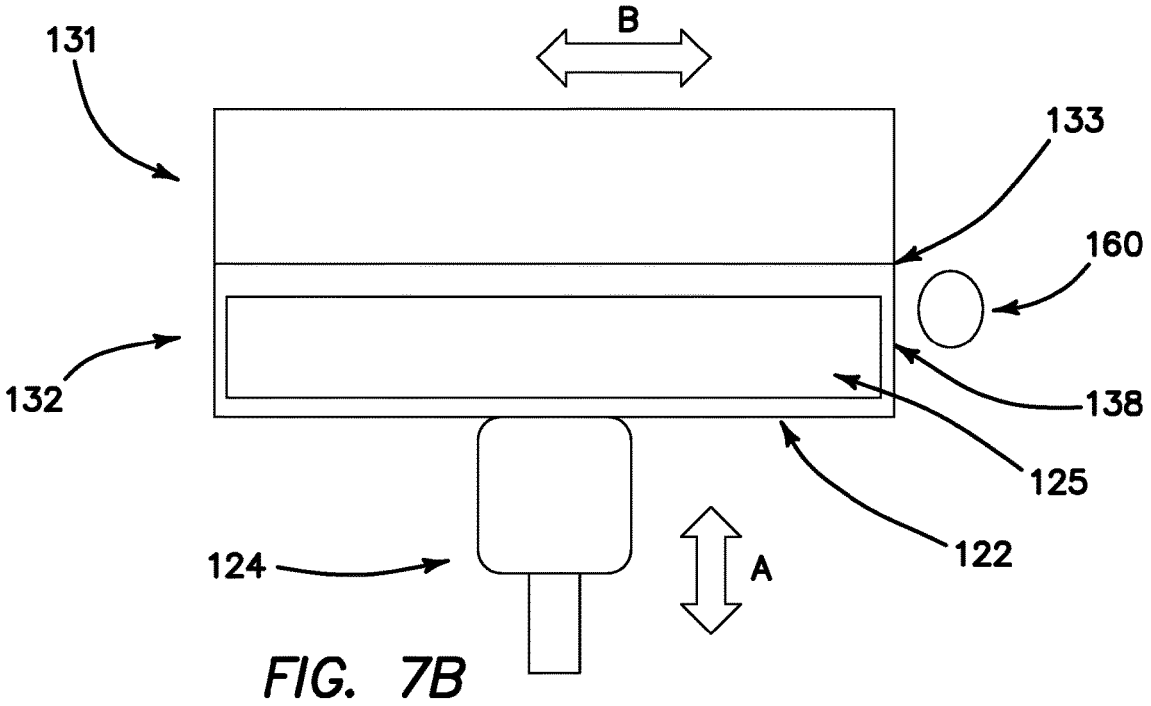
FIG. 7B illustrates a cross-sectional side view of the card-selector assembly in a home position according to the embodiments of the present invention.
Figure 7C:
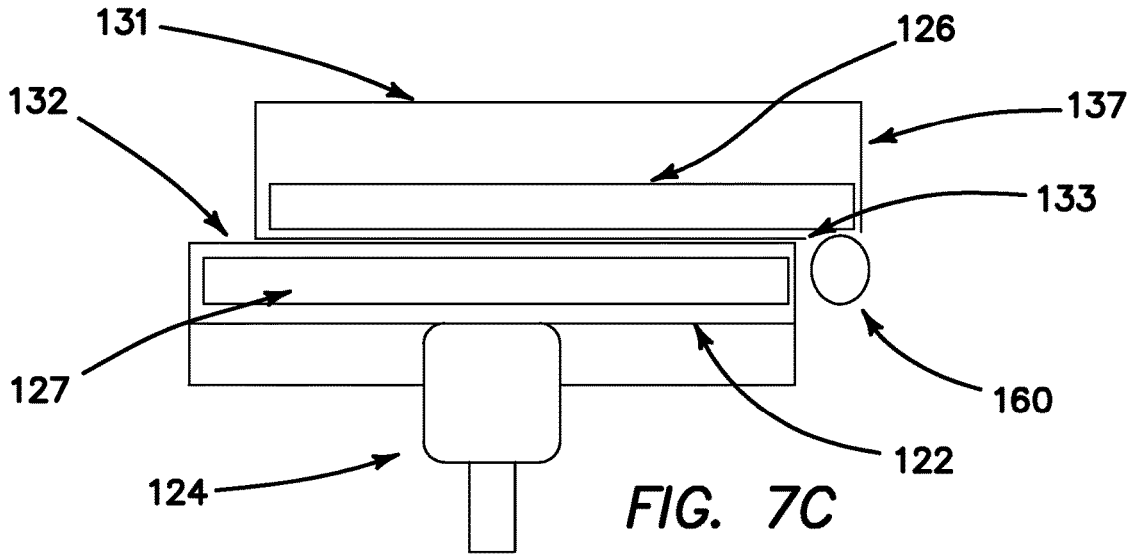
FIG. 7C illustrates a cross-sectional side view of the card-selector assembly with upper body in forward position according to the embodiments of the present invention.

FIGS. 7B and 7C show cross-sectional views of the card-selector assembly 130 in a home position and forward position. In FIG. 7B, the upper body 131 and lower body 132 are aligned with a deck of cards 125 in the pre-shuffle bin 120. Stepper motor 124 acts on pre-shuffle bin base 122. Arrows A and B represent potential movements of the upper body 131 and pre-shuffle bin base 122. FIG. 7C shows the pre-shuffle bin base 122 raised and the upper body 131 moved forward pursuant to a randomly-generated card number. The forward movement of the upper body 131 separates the deck of cards 125 into an upper portion 126 and lower portion 127. In this offset position, the drive wheel 160 may propel the bottom card in the upper portion 126 of cards into a post-shuffle bin 200. Wall 137 of upper body 131 and wall 138 of the lower body 132 collectively allow only the bottom card of the offset upper portion of cards 126 to be propelled into the post-shuffle bin 200 by the drive wheel 160. Wall 137 prevents cards above the selected card from being propelled while wall 138 prevents any cards 127 below the selected card from being moved from the pre-shuffle bin 200 by the movement of the upper body 131. That is, once the upper body 131 moves into an offset position relative to the lower body 132, the gap 133 transforms into a passageway or similar clearance for the selected card to be propelled by the drive wheel 160 into the post-shuffle bin 200.

In one embodiment, the processor 103 is configured to place the shuffler 100 in a short-cycle mode. Responsive to one or more sensors detecting a time below a pre-established threshold time (e.g., 20 seconds) between cuts of successive shuffled decks of cards by the dealer, the processor 103 places the shuffler 100 into short-cycle mode wherein, the shuffler randomly selects a pre-established number of cards (e.g., 35) for shuffling as described herein and then moves consecutively in order the remaining cards from the pre-shuffle bin 120 to the post-shuffle bin 200 on top of the previously shuffled cards. When the deck is removed from the post-shuffle bin 200, the dealer cuts the deck such that the consecutively-moved cards are moved to the bottom of the deck prior to dealing. The consecutively-moved cards are those remaining after the shuffling of the pre-established number of cards so even if some on the consecutively-moved card end up in play, they have been adequately shuffled. The short cycle mode is advantageous for fast-paced games (i.e., heads-up).

In one embodiment, an automatic calibration system is premised on card or deck thicknesses as measured by sensors proximate to the pre-shuffle and/or post-shuffle bin. Sensors 104, 105 may measure card thicknesses or additional sensors may be installed for the specific purpose. Given the tendency of playing cards (paper and plastic) to expand during use, it is beneficial to calibrate the automatic card shuffler so that the stepper motor 124 is moved at accurate tolerances to ensure that the randomly-selected card is the card propelled by the drive wheel 160 to the post-shuffle bin 200. Responsive to detecting the thicknesses of cards expanding, the automatic calibration system, via processor 103, communicates to the stepper motor 124 to alter the distance the stepper motor 124 raises and lowers for each card position.

In another embodiment, a card-counting sensor 106 may be used to sense each card moving from the pre-shuffle bin 120 to the post-shuffle bin 200 so the deck count may be verified. The card-counting sensor 106 may be positioned between the pre-shuffle bin 120 and post-shuffle bin 200. In an alternative embodiment, the automatic card shuffler 100 may incorporate a card reading system (e.g., image capturing technology) to identify the rank and suit of each card thereby verifying the exactness of the deck of cards.

Figure 12A:
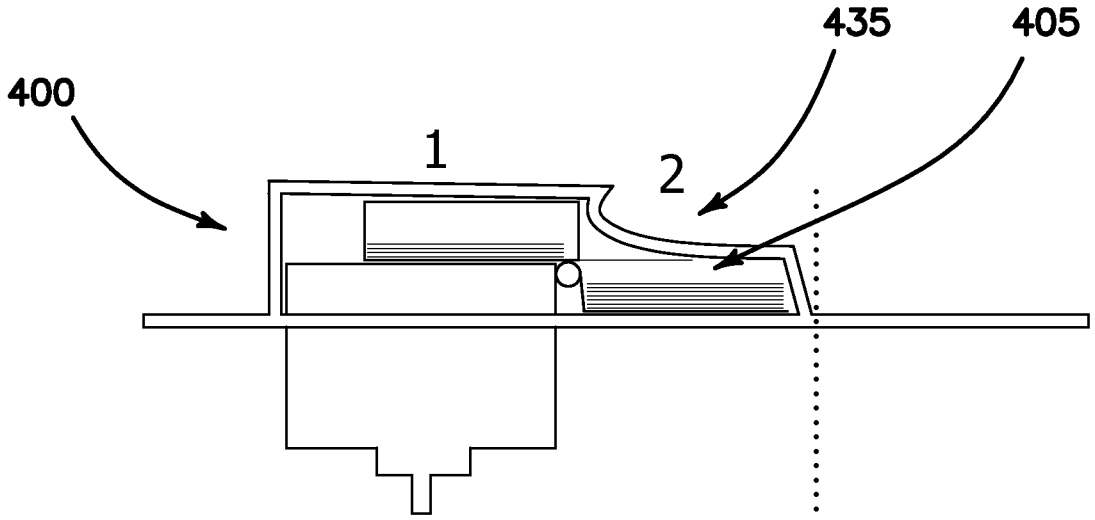
FIGS. 12A-12H illustrate various post-shuffle bin configurations according to the embodiments of the present invention.
Figure 12B:
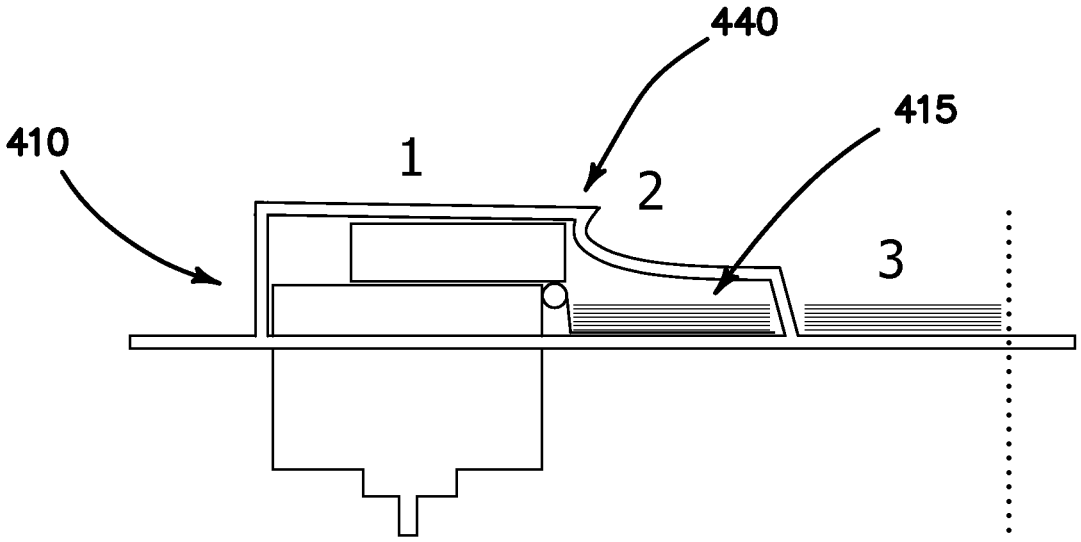

FIGS. 12A-12H show various post-shuffle bin configurations according to the embodiments of the present invention. Once the deck of cards has been shuffled, the shuffled cards must then be accessed by the dealer. In one embodiment, unshuffled cards are placed in the pre-shuffle bin 120 before the shuffled cards are removed from the post-shuffle bin 200 in batch shuffler style so that two decks of cards are shuffled in a revolving fashion. Depending on the embodiment, the shuffler 100 may be a two-position automatic shuffler or three-position automatic shuffler. As shown in FIGS. 12A and 12B, a two-position automatic shuffler 400 permits the dealer to access the shuffled cards directly from the post-shuffle bin 405 while a three-position automatic shuffler 410 involves automatically moving the shuffled cards from the post-shuffle bin 415 to a position external to the shuffler. Covers 435, 440 conceal the internal components of the automatic shufflers 400, 410. It is evident from FIGS. 12A-12H that a majority of the automatic card shuffler is positioned below the upper surface of the card table. In one embodiment, the automatic card shuffler raises no more than 2" above the upper surface of the card table or chip tray. It is conceivable that the automatic card shuffler may be oriented at an angle to permit gravity to assist with moving cards from a pre-shuffle bin to the post-shuffle bin.

Figure 12C:
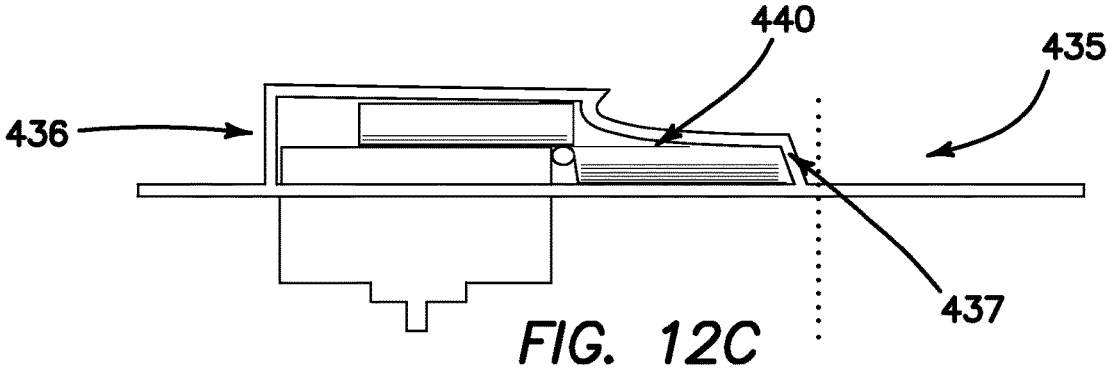
Figure 12D:
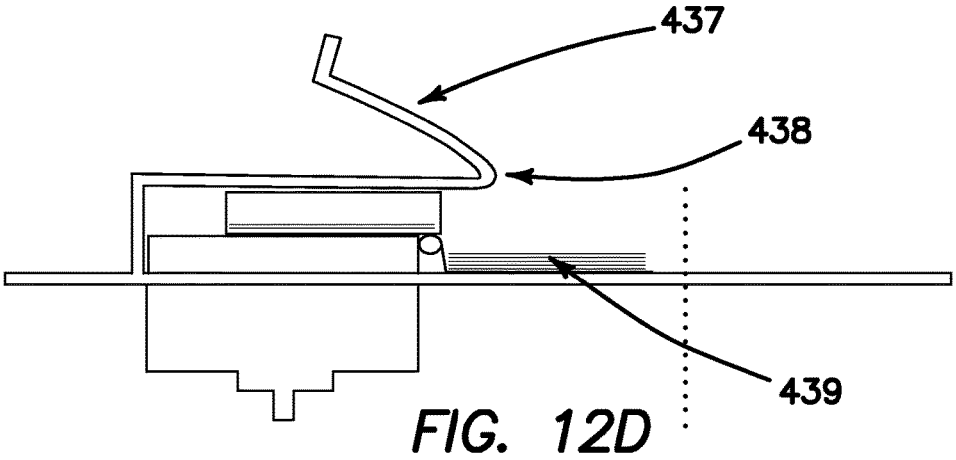
Figure 12E:
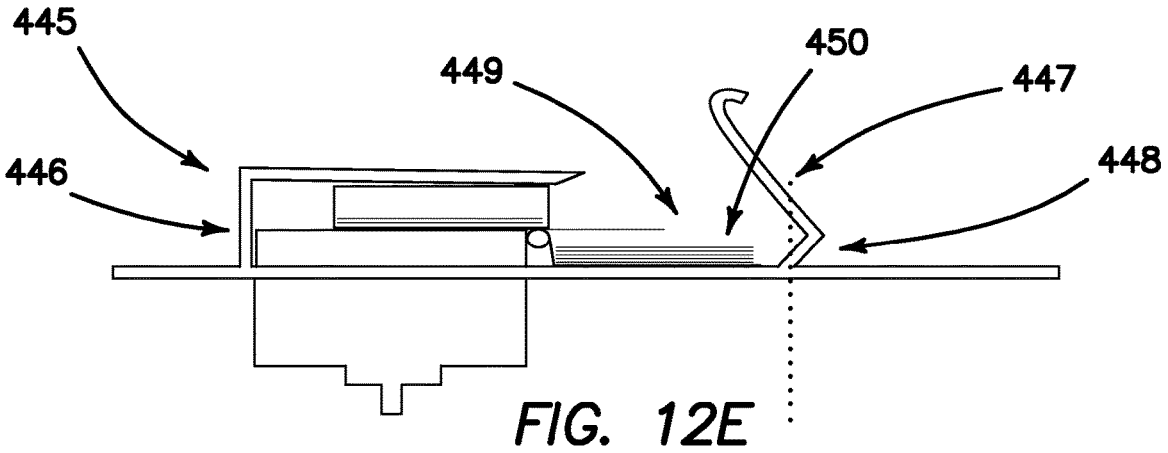

FIGS. 12C and 12D show a two-position automatic shuffler 435 having a cover 436 with a door 437 which flips upward about a hinge 438 permitting access to the shuffled cards 439 in the post-shuffle bin 440. FIG. 12E shows another two-position automatic shuffler 445 having a cover 446 with a door 447 which flips upward about a hinge 448 permitting access to the shuffled cards 449 in the post-shuffle bin 450.

Figure 12F:
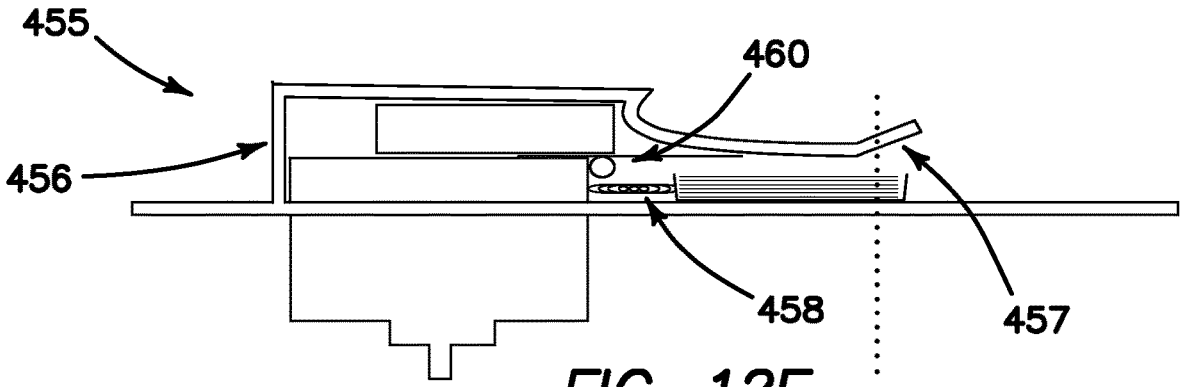
Figure 12G:
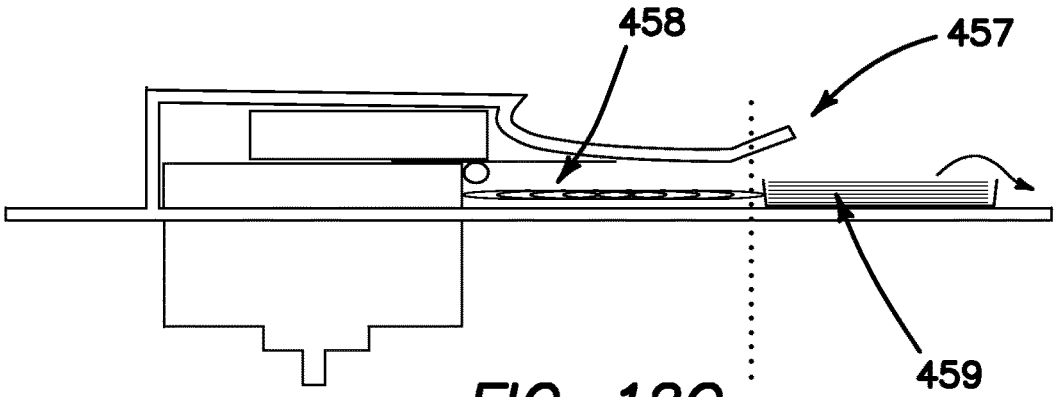
Figure 12H:
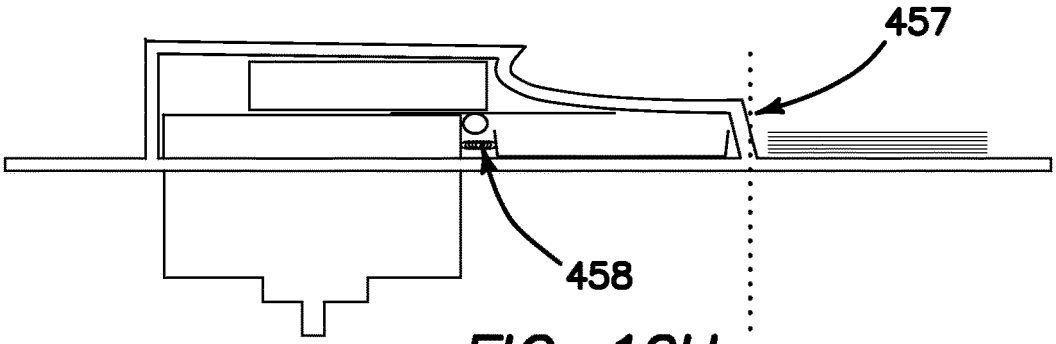

FIGS. 12F through 12H show a three-position automatic shuffler 455 having a cover 456 with a door 457 which flips upward allowing a plunger 458 to push shuffled cards 459 from the confines of the automatic shuffler 455. While a plunger 458 is described, it is apparent that any physical article capable of pushing, or otherwise moving, a deck of cards a short distance from the post-shuffle bin 460 to a position external and proximate thereto may be utilized to achieve the objective of the three-position automatic shuffler.

The processor 103, as described above, also controls the doors 437, 447, 457 and plunger 458, or other article, pursuant to sensor feedback indicating the deck of cards has been shuffled and is ready for game play.

Figure 14A:
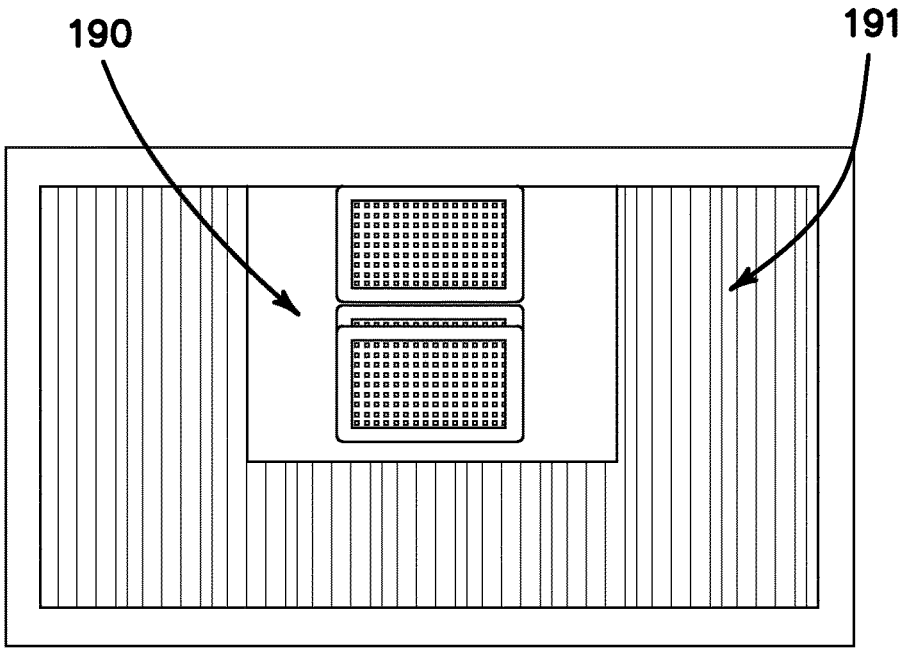
FIGS. 14A and 14B illustrate positioning of the automatic shuffler integrated into a poker table and chip tray according to the embodiments of the present invention.
Figure 14B:
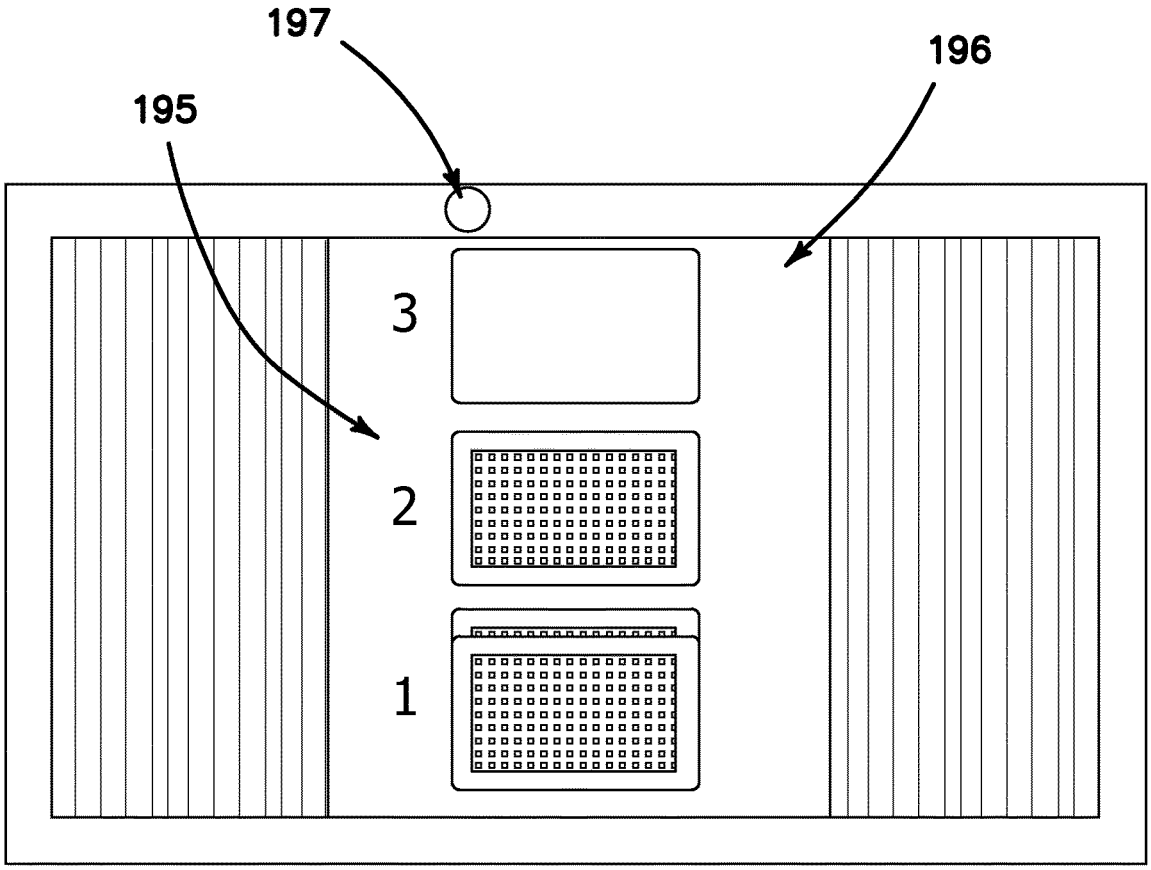
Figure 15A:
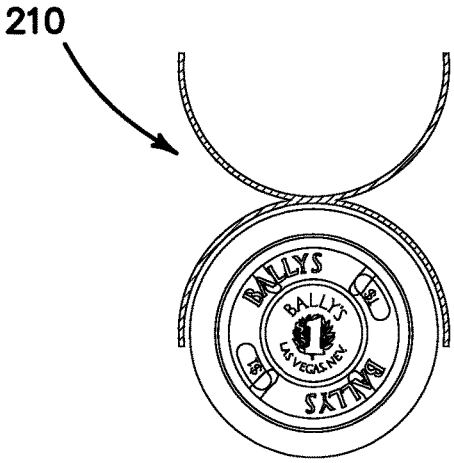
FIGS. 15A and 15B illustrate chip tray toppers according to the embodiments of the present invention.
Figure 15B:
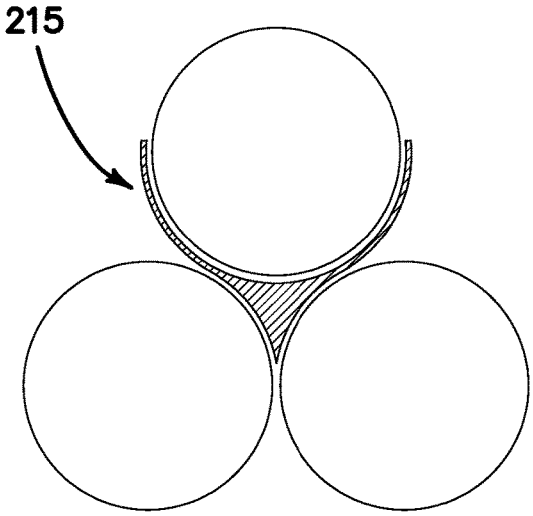

FIGS. 14A and 14B show positioning of the automatic shuffler integrated into a poker table adjacent to a modified chip tray according to the embodiments of the present invention. FIG. 14A shows a footprint 190 of a two-position shuffler integrated into a poker table within a cut-out in chip tray 191 while FIG. 14B shows a footprint 195 of a three-position shuffler integrated into a poker table within a cut-out in chip tray 196. In another embodiment, the chip tray may be U-shaped and configured to slide onto the poker table around the shuffler. FIG. 14B also shows an optional reader 197 for identifying the bottom card as it passes thereover and a bottom card after a deck cut. In conjunction with an internal card reading system, the readings of sensor 197 can be used to verify deck order, etc. In either embodiment, a portion of the chip tray 191, 196 meant to retain gaming chips is eliminated. Accordingly, FIGS. 15A and 15B illustrate chip tray toppers 210, 215 according to the embodiments of the present invention. The chip tray toppers 210, 215 permit gaming chips to be stacked in the chip trays 191, 196 to increase capacity eliminated by the integration of the automatic card shuffler. The chip trays toppers 210, 215 may be fabricated of plastics, composites, alloys, metals or combinations thereof. In one embodiment, the chip tray toppers 210, 215 incorporate magnets, hooks, latches or other connectors to secure the chip tray toppers 210, 215 to the chip rack or other article.

One or more LEDs may be integrated into the automatic card shuffler to indicate shuffler status. With an LED, different colors and/or blinking speeds are indicative of shuffler status including ready to load status, ready to remove shuffled cards status, card jam status, missing card status, etc.

While the shuffler 100 has been detailed relative to a poker game, it should be understood that the shuffler 100 may be suitable for any number of cards games with modification. As described herein, the shuffler 100 can be used for a single blackjack game. A two-deck blackjack game requires that the shuffler 100 have a slightly increased profile (<1" more than a single deck) to accommodate the additional deck of cards.

With carnival games or novelty games (e.g., Three Card Poker) the hands are dealt by a dealing module forming part of the shuffler. Each hand is then provided to the player by the dealer. Given the design of the shuffler 100, the process of dealing hands is very simple and efficient as the shuffler 100 may pause after each hand is formed and re-start after each hand is dealt. In one embodiment, a blocking wall is attached to sides of the shuffler 100 (with the post-shuffle bin 200 removed or re-configured to allow cards to exit the shuffler 100) so that cards propelled from the pre-shuffle bin 120 strike the blocking wall landing on the table surface or previous propelled cards. The blocking wall may be modest in height/width serving only to stop propelled cards so that the cards stack on top of one another. Once a hand is formed, the shuffler 100 pauses. An arm or lever then moves part or all of the formed hand away from the blocking wall allowing the dealer to grab and deal the hand. One or more sensors proximate to the blocking wall detect when the formed hand has been removed and trigger the shuffler 100 to begin again and deal a next hand. The process continues until a button or other input device, used by the dealer, alerts the shuffler 100 that the next hand is the final hand (i.e., dealer hand) to be dealt which causes the shuffler 100 to handle the remaining cards in the shuffler in one of several ways.

In a dual deck embodiment (i.e., batch), once each of the hands has been dealt, the shuffler 100 consecutively propels the remaining cards against the blocking wall thereby emptying the shuffler of cards for the second deck to be inserted. In another embodiment, the remaining cards may be pushed together from the shuffler 100 by a mechanical device (e.g., arm) or similar article. With such an embodiment, wall 137 of upper body 131 may rotate open allowing the remaining cards to be collectively pushed from the shuffler 100 by the mechanical device. In a single deck embodiment where only one deck is used, the remaining cards may be maintained in the pre-shuffle bin 120 until the played cards are inserted back on top so that the shuffling process may begin again.

To minimize movement and maximize dealing speed, the shuffler 100 may not propel the selected cards in the order they are randomly selected. For example, if the three randomly selected cards for a Three Card Poker game are numbers 1, 52 and 2 in that order, rather than deal the cards in the selected order, the shuffler 100 may deal the hand by propelling cards 52, 2 and 1 to minimize shuffler movement while increasing the deal pace. With a single player hand, the order of the cards in the hand is irrelevant.

Figure 16A:
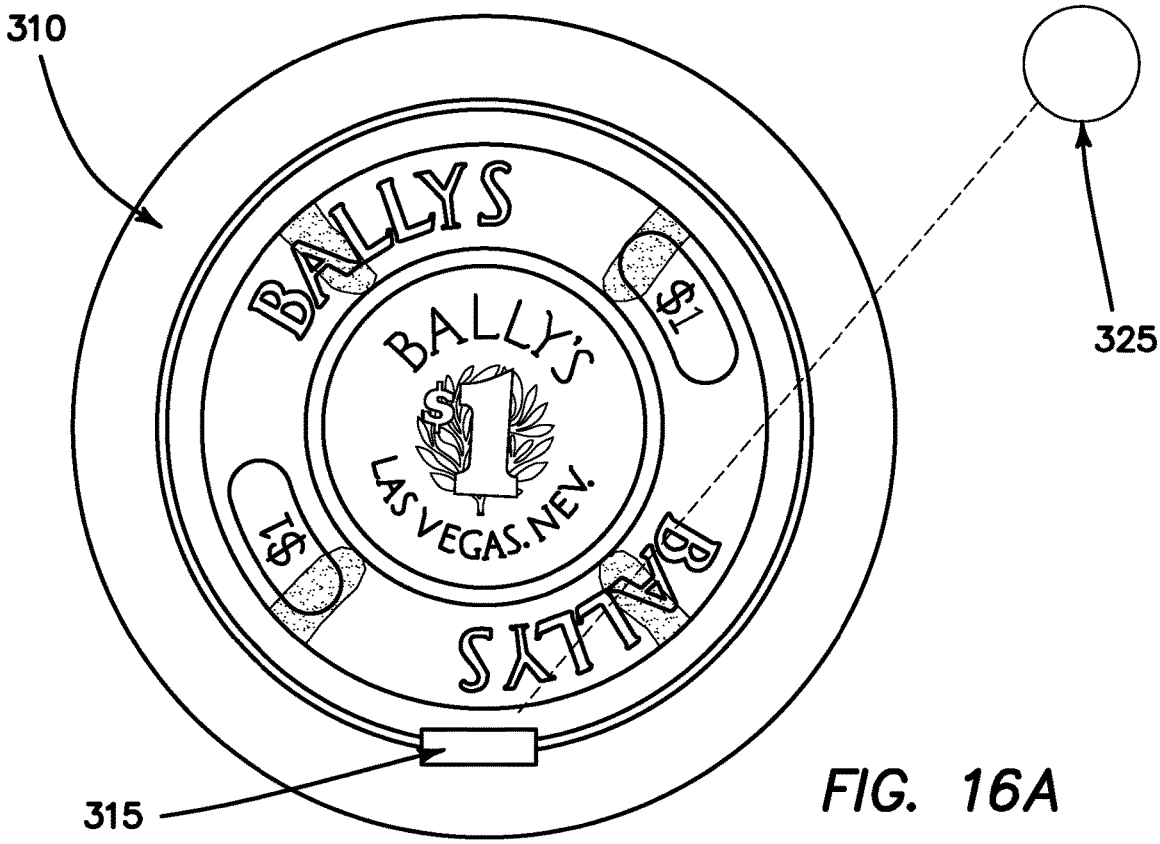
FIGS. 16A-16C illustrate a coin drop mechanism according to the embodiments of the present invention.
Figure 16B:
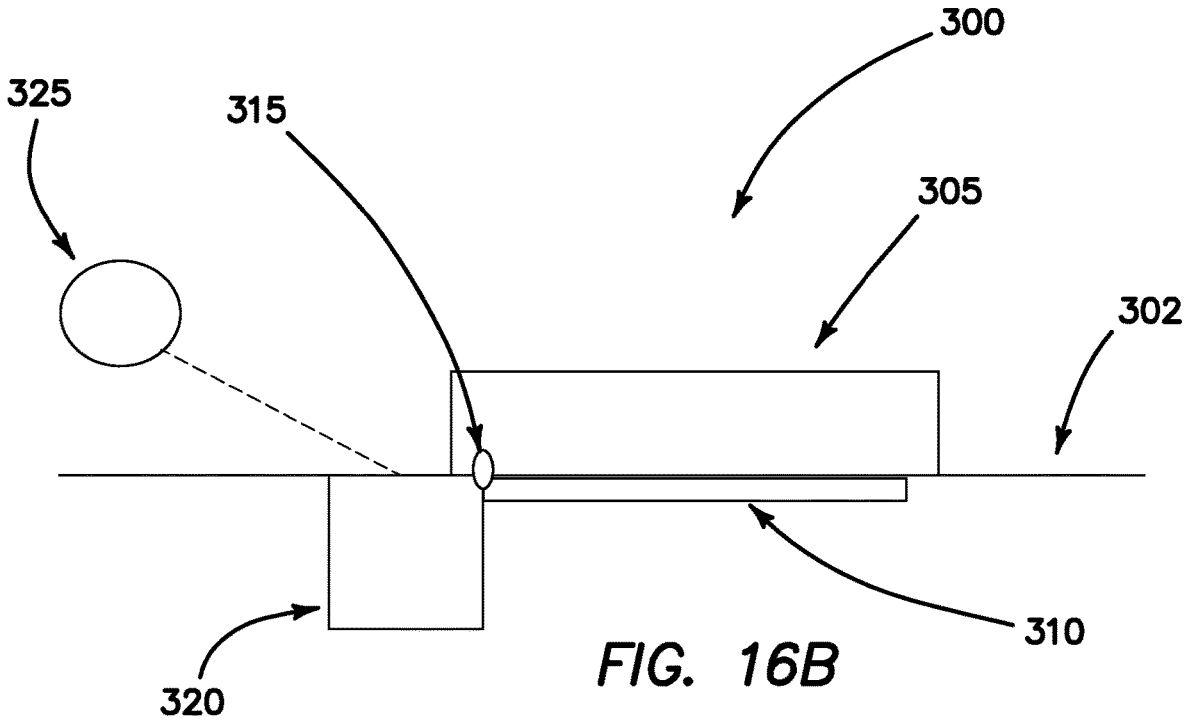
Figure 16C:
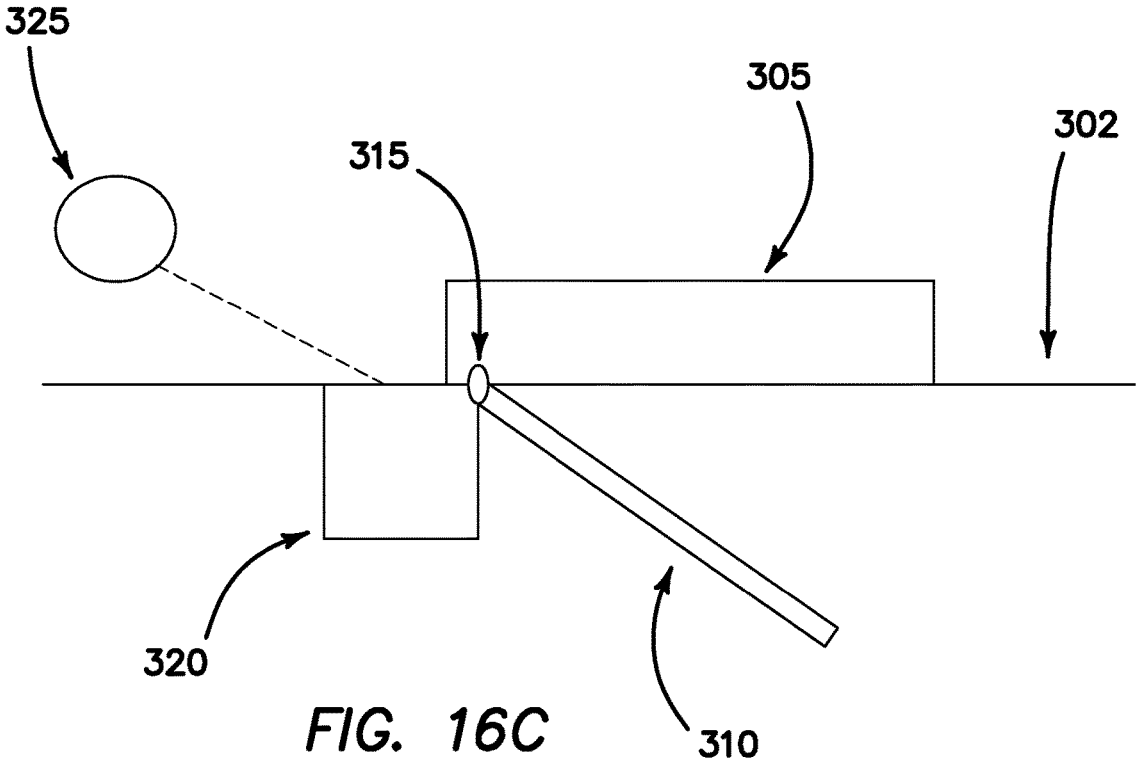

Another embodiment of the present invention involves an automated rake drop device 300. During live poker games, dealers rake (i.e., collect) a portion of each pot for the house. The rake acts as a fee for the house operating the game. The normal rake procedure involves the dealer taking chips from the poker pot and placing them onto a drop slot covered by a slidable lever. After the hand ends and the pot is pushed to the winning player(s), the dealer opens the slot using the slidable lever allowing the chips to fall through an opening in the poker table into a drop box connected to an underside of the poker table. As shown in FIGS. 16A through 16C, the present invention is directed to a circular drop 300 comprising a frame 305, drop cover 310, hinge 315, micro-switch/receiver 320 and sensor/transmitter 325 integrated into a poker tabletop 302. FIGS. 16B and 16C show a side view of the drop cover 310 in a closed position and open position respectively. The sensor 325 resides in the shuffler described herein or any shuffler such that the sensor 325 is able to detect when the next game's cards have been shuffled and removed from the shuffler. Once the shuffled deck is removed from the shuffler, the sensor 325 causes the micro-switch 320 to open the drop cover 310 via hinge 315 (as shown in FIG. 16C) allowing chips thereon to fall into the drop box below. The sensor 325 and micro-switch 320 may communicate via a wired or wireless connection.

The shuffler technology detailed herein may be used for a multi-deck shuffler (e.g., 4-8 decks) as well. In one embodiment, a multi-deck shuffler comprises a single unit having two shuffler components and a shared post-shuffle bin into which both shuffler components propel cards from bins of each shuffler. A vertical pre-shuffle bin accepts, for example, six decks of cards comprising 312 cards (6×52). A mechanism (e.g., rollers, pusher, etc.) separates the six decks in two substantially equivalent stacks with one stack being deposited into a bin of one shuffler component and a second stack being deposited into a bin of the other shuffler component. Selected random numbers then cause the shuffler component to propel cards into a common post-shuffle bin. In one embodiment, the random number generator selects a number from 1-312 and the shuffler component holding the selected card propels the card into the shared post-shuffle bin. Alternatively, each shuffler component may have its own random number generator such that each shuffle component may act independently. Regardless of the process, the result is six decks of shuffled cards requiring only a single shuffle. As the post-shuffle bin is vertically oriented, once the shuffle process concludes, a mechanism tips the post-shuffle bin into a horizontal position such that the shuffled cards are made available to the dealer. In one embodiment, a shallow frame associated with the post-shuffle bin maintains the decks in an orderly arrangement. A sensor detects when the post-shuffle bin is empty causing the post-shuffle bin to close.

Depending on the embodiment, the two shuffle apparatuses may have a different, unknown number of cards. For example, if a pusher is used to separate the 312 cards into two separate stacks, the number of cards in each shuffler apparatus may be unequal. The system firmware is configured to assume an equal number of cards in each shuffler apparatus so that the shuffling process continues in a normal fashion until it is determined that such is not the case. If one of the shuffler apparatuses attempts to shuffle a card but no card exists at the selected location, the bin base continually raises one spot until a card is located. From this exercise, the shuffler firmware can determine a number of cards in each shuffler apparatus and continue the shuffle normally until complete.

A multi-deck shuffler is ideal for handling a Baccarat game. The concept of shuffling and dealing simultaneously is only possible with a random-selection shuffler. In a game wherein players and a dealer each receive three cards, three cards are randomly selected and moved to the gaming table ready for dealing to the player or dealer. This occurs after only three cards have been moved from the unshuffled deck. Contrarily, random-position shufflers require each card to be moved to a random position, shelf or slot before they can be dispensed as complete, individual hands. That is, random-position shufflers require all unshuffled cards to be moved before the dealing phase.

In one embodiment, a Baccarat shuffler 400 is configured to randomly select and shuffle enough cards to complete a round of play as opposed to enough cards to fill a hand. In this manner, the round of cards may be used to deal cards in the traditional fashion (i.e., one card at a time to each player position). With current market shufflers, novelty game hands are dealt such that players and the dealer receive hands in a single group of cards rather than one at a time.

Figure 18A:
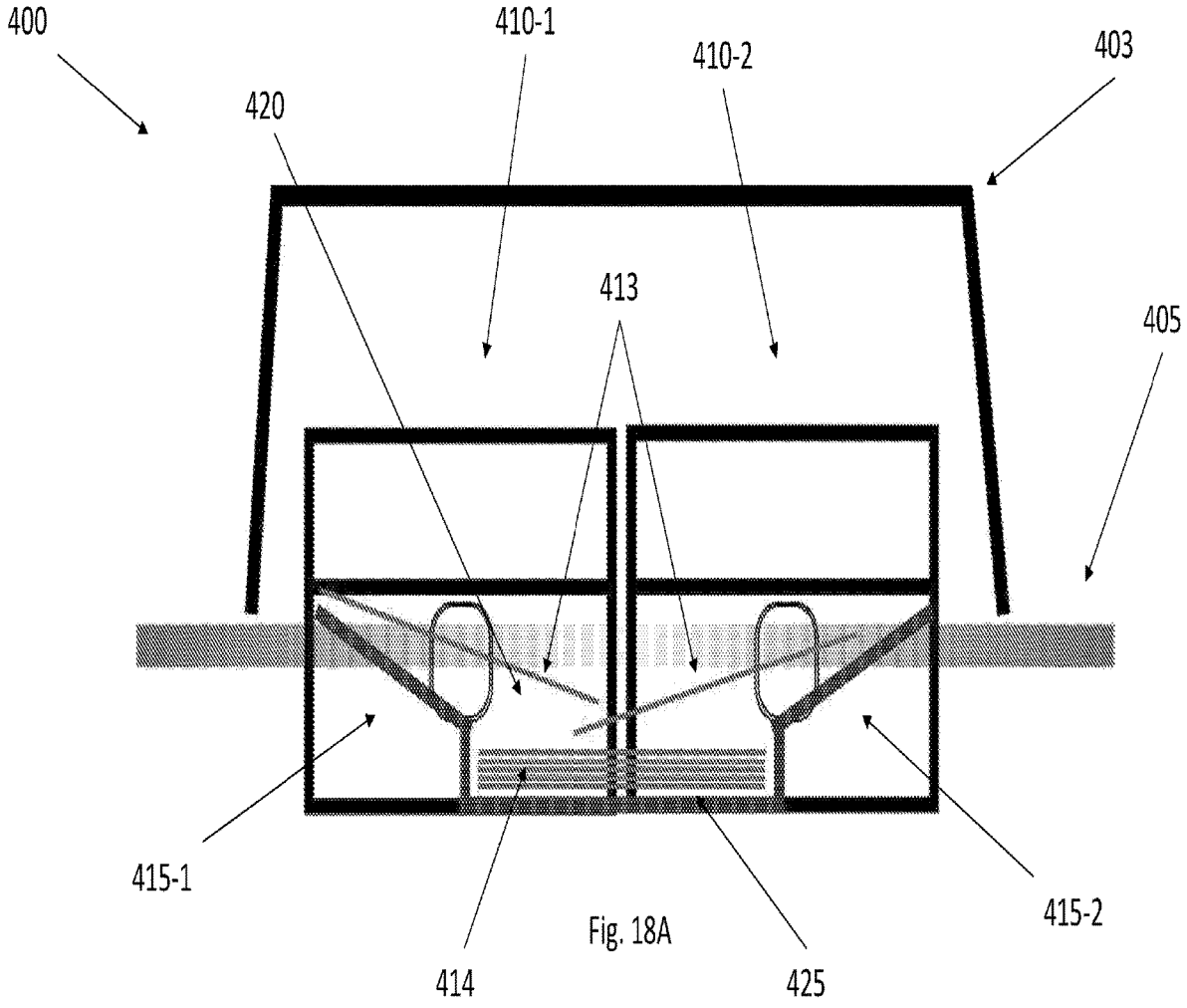
FIGS. 18A and 18B illustrate a cross-sectional front end view of a Baccarat shuffler according to the embodiments of the present invention.
Figure 18B:
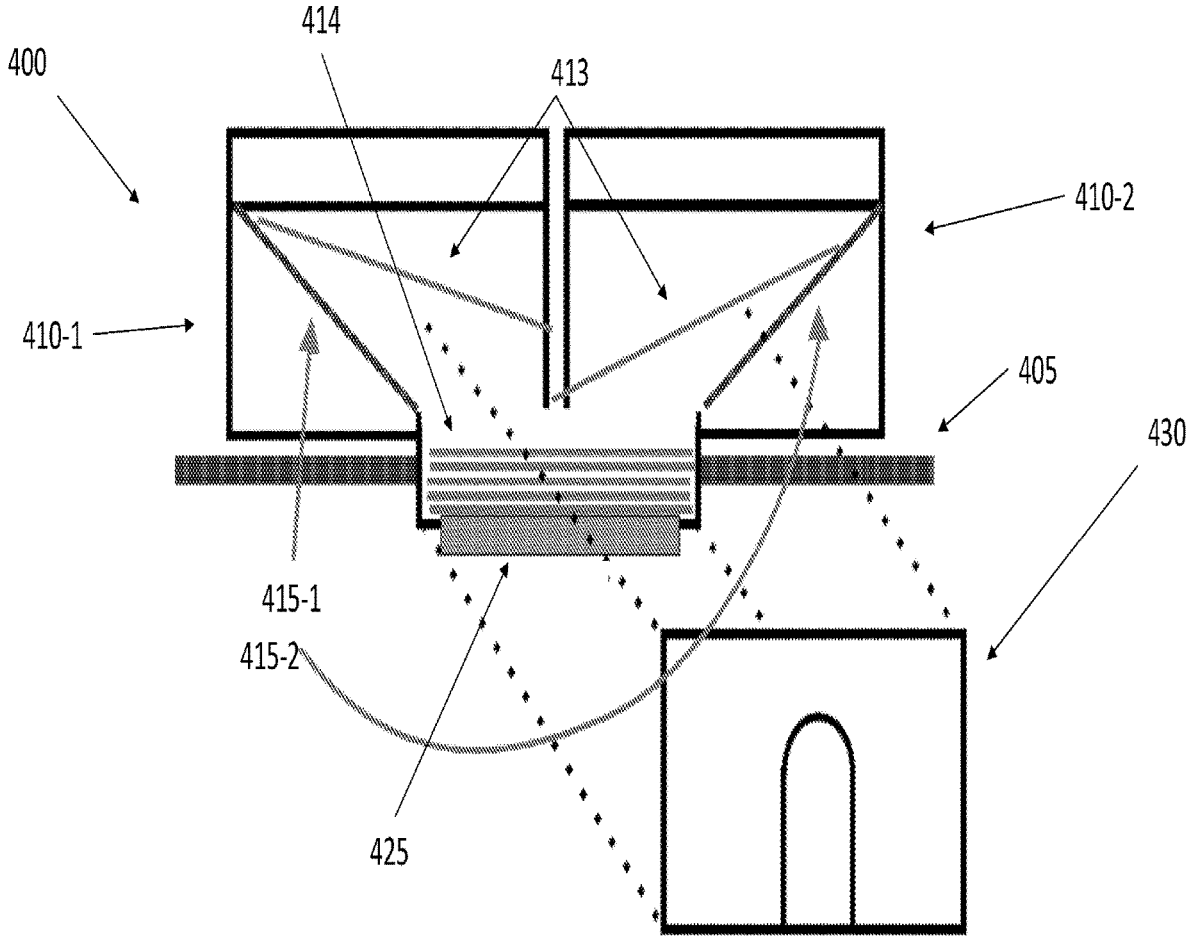

FIGS. 18A and 18B show cross-sectional front end views of the Baccarat shuffler 400 mounted to a gaming table 405 according to the embodiments of the present invention. The Baccarat shuffler 400 includes two separate random-selection shuffler devices 410-1, 410-2 within a shuffler housing 403. The two shuffler devices 410-1, 410-2 are spaced with card outputs facing a front of the Baccarat shuffler 400 (towards a viewer of FIG. 18) and a common card-receiving area 420. The card-receiving area receives cards randomly selected and propelled or moved from the first group of cards and second group of cards. Thus, the cards moved into the card-receiving area are shuffled. Each of the shuffler devices 410-1, 410-2 includes a pre-shuffle bin. The shuffler devices 410-1, 410-2 are each rear of a respective card slide 415-1, 415-2 positioned to direct randomly-selected and forwardly propelled or moved cards 414 from each shuffler device 410-1, 410-2 into the common card-receiving area 420 and on to a flipper mechanism 425. An integral dealing shoe 430 or partial shoe provides dealer access to shuffled cards as detailed below. The configuration of the Baccarat shuffler 400 provides a much smaller profile than other shufflers designed to shuffle multiple decks of cards. Accordingly, when installed on a gaming table, the Baccarat shuffler 400 does not interfere with dealer actions as larger profile shufflers might.

Besides providing a smaller profile, the use of two shuffler devices 410-1, 410-2 inherently results in a faster shuffling process. The speed of the two shuffler devices 410-1, 410-2 is further increased when the next two random cards are selected from different shuffle devices 410-1, 410-2, as the first shuffler device 410-1 moves to select the card in its pre-shuffle bin, the second shuffle device 410-2 can begin moving to locate the card in its pre-shuffle bin.

Loading the Baccarat shuffler 400 begins with a dealer dividing eight decks of cards into two piles of approximately equal cards. Given the operation of the two shuffler devices 410-1, 410-2, the two piles of cards do not have to be equal. Once the two piles are created, a two-step loading process begins. The Baccarat shuffler 400 is configured, responsive to a dealer "Load" input (e.g., button, touch screen interface, etc.), one of the pre-shuffle bins of one of the shuffler devices 410-1 raises to an upper-most position while the pre-shuffle bin of the other shuffler device 410-2 remains at a lowest-most position. Once the first pre-shuffle bin is loaded with one pile of cards, the dealer may utilize a "Loaded" input to cause the first pre-shuffle bin to move to a home position while the other pre-shuffle bin moves to a highest-most position. Alternatively, one or more sensors located in the pre-shuffle bins may automatically trigger the raising and lowering of the pre-shuffle bins upon cards being loaded into the first pre-shuffle bin. Once the second pre-shuffle bin raises to the upper-most position, the second pile of cards is loaded. The dealer may complete the loading process by utilizing the "Loaded" input again or sensors may trigger an automatic movement whereby the second pre-shuffle bin returns to a home position.

The shuffler operation is set forth above and the only difference is that the two shuffler devices 410-1, 410-2 operate individually to randomly select and propel cards 413 from the respective piles of cards into the common card-receiving area 420 and on to the card flipper 425.

Conducting a Baccarat game includes two procedures for burning cards. The first procedure involves burning a single card. The second procedure turns the top card face up and burns an additional number of cards equal to the face-up cards value. For example, if the top card is a seven, seven cards are burned whereas if the top card is a ten, ten cards are burned. Casinos may also implement other burn card procedures which the Baccarat shuffler 400 can be configured to shuffle and deal.

In a first embodiment, the Baccarat shuffler 400 shuffles eight cards and forces them against a dealing shoe face plate (see, FIGS. 19A-19M and 20A-20F) before the top card is burned and the first round is dealt. The maximum number of cards required to deal a Baccarat round is six cards—the player and the banker each receive two cards initially and may take, based on the rules, one additional card. Shuffling eight cards for the first round provides a burn card and one extra cover card remaining in the shoe in the event six cards are required to deal the round. In a second embodiment, the Baccarat shuffler 400 shuffles eighteen cards to accommodate one face-up burn card, a maximum number of six game cards, a maximum of ten burn cards and one cover card. Different casinos elect to burn one or eleven cards in the event the top card is an Ace. Another Baccarat variant involves burning no cards when the top card has a ten value (e.g., ten, Jack, Queen or King) since such cards have zero value in the Baccarat game. The Baccarat shuffler 400 is configured to handle at least the four most-common burn card variations, namely (i) a single face-down card; (ii) a single face-up card plus number of burn cards equal to the top card value (Ace=1); (iii) a single face-up card plus number of burn cards equal to the top card value (Ace=11) and (iv) single face-up card plus number of burn cards equal to the top card value (ten value cards=0). It is well-understood that the Baccarat shuffler 400 may be configured to accommodate any conceivable burn card variation.

With the single face-down card burn card variation, the Baccarat shuffler 400 first randomly selects and forces eight cards against the dealing shoe face plate (deemed an eight-card buffer) and then seven-card buffers for each subsequent round until a new fresh game shuffle. Dependent upon the number of cards used to play the previous hand of the Baccarat game, the Baccarat shuffler 400 is configured to shuffle a sufficient number of cards to create the seven-card buffer. If the first round requires six cards to play, six more cards are shuffled to maintain the seven-card buffer for the next round; if the first round requires five cards to play, five more cards are shuffled to maintain the seven-card buffer for the next round and if the first round requires four cards to play, four more cards are shuffled to maintain the seven-card buffer for the next round. With the single face-up card plus number of burn cards equal to the top card value (Ace=1) burn card variation, the Baccarat shuffler 400 first randomly selects and forces eighteen cards against the dealing shoe face plate and then seven-card buffers for each subsequent round until a new fresh game shuffle. With the single face-up card plus number of burn cards equal to the top card value (Ace=11) burn card variation, the Baccarat shuffler 400 first randomly selects and forces nineteen cards against the dealing shoe face plate and then seven-card buffers for each subsequent round until a new fresh game shuffle. With the single face-up card plus number of burn cards equal to the top card value (ten value cards=0) burn card variation, the Baccarat shuffler 400 first randomly selects and forces seventeen cards against the dealing shoe face plate and then seven-card buffers for each subsequent round until a new fresh game shuffle.

Figure 19A:
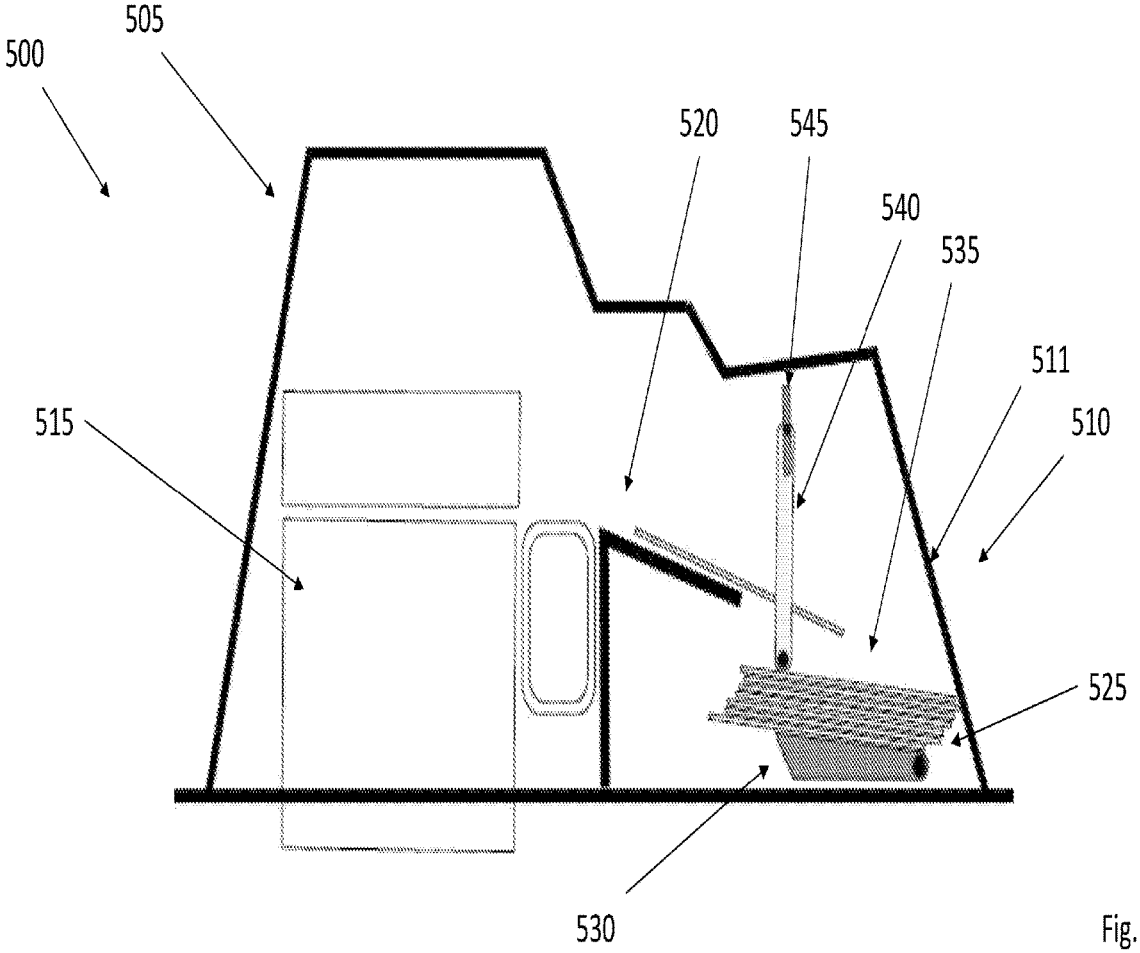
Figure 19B:
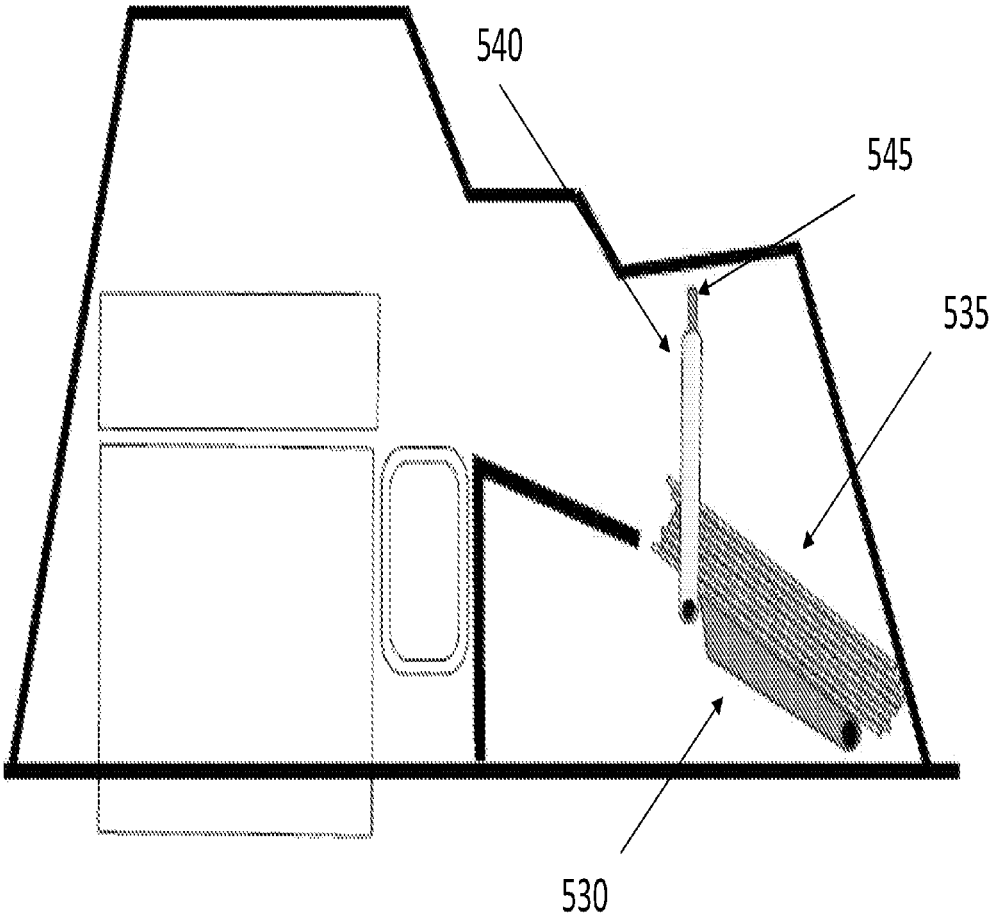
Figure 19C:
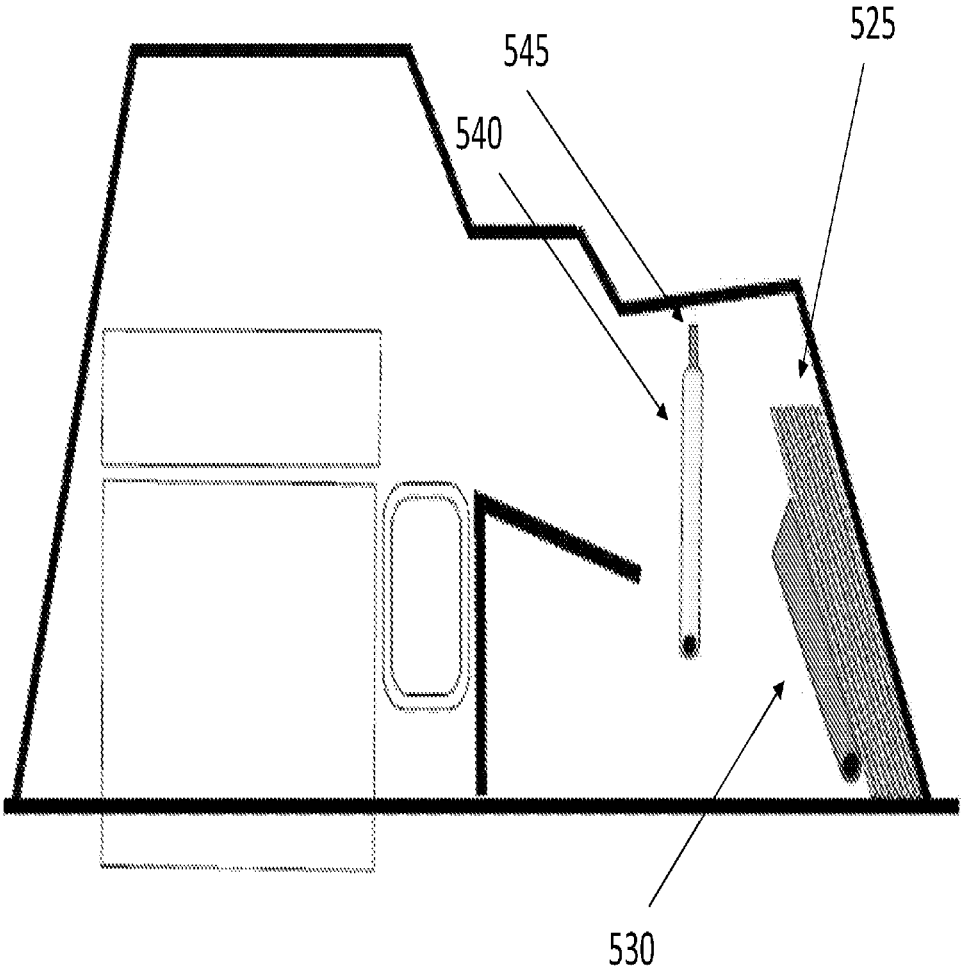
Figure 19D:
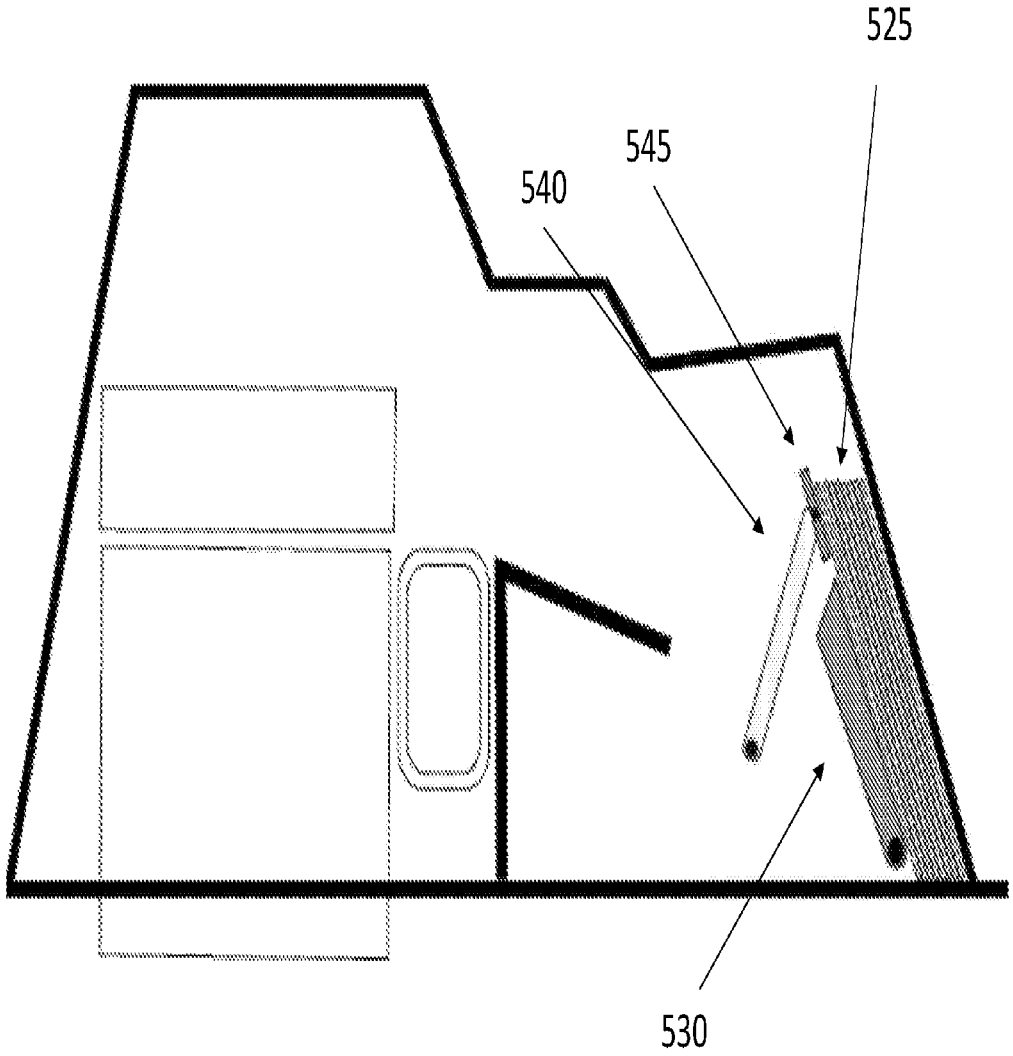
Figure 19E:
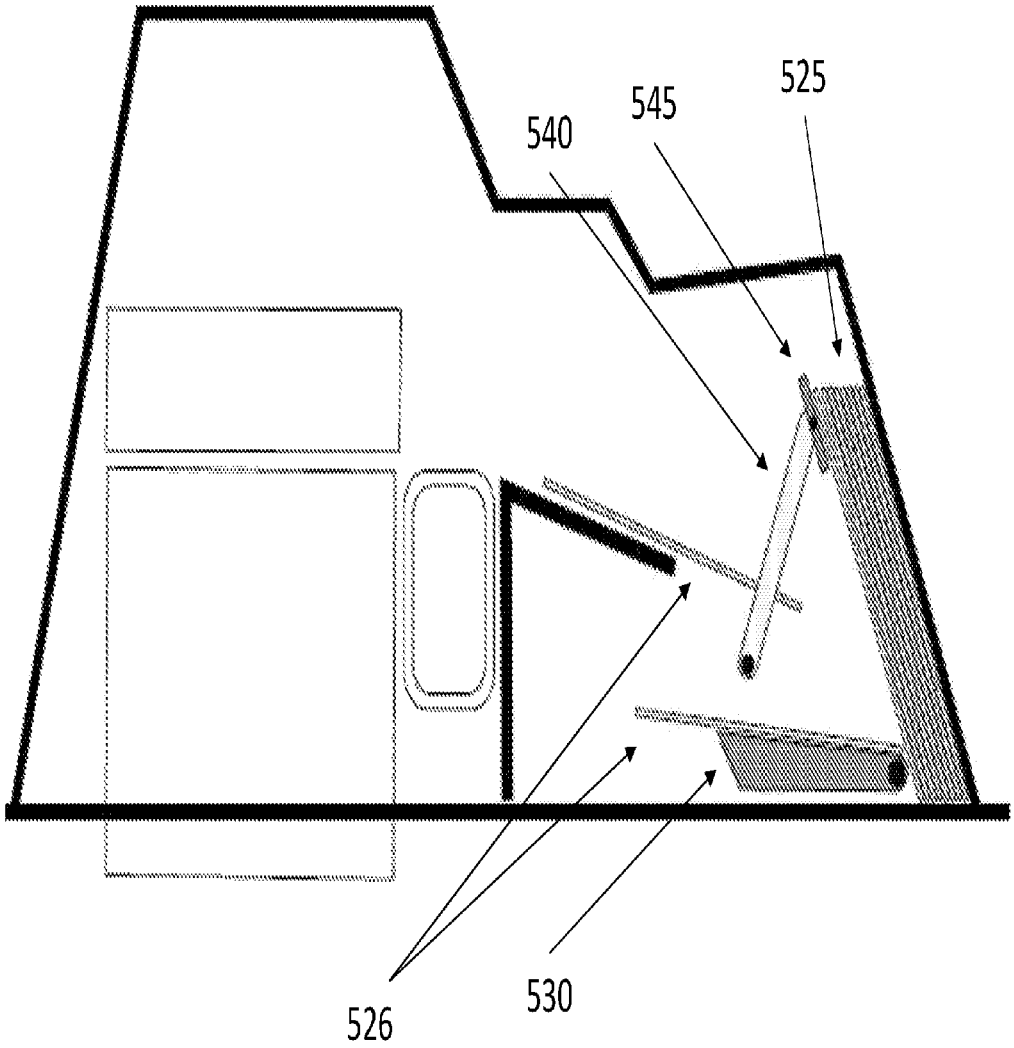
Figure 19F:
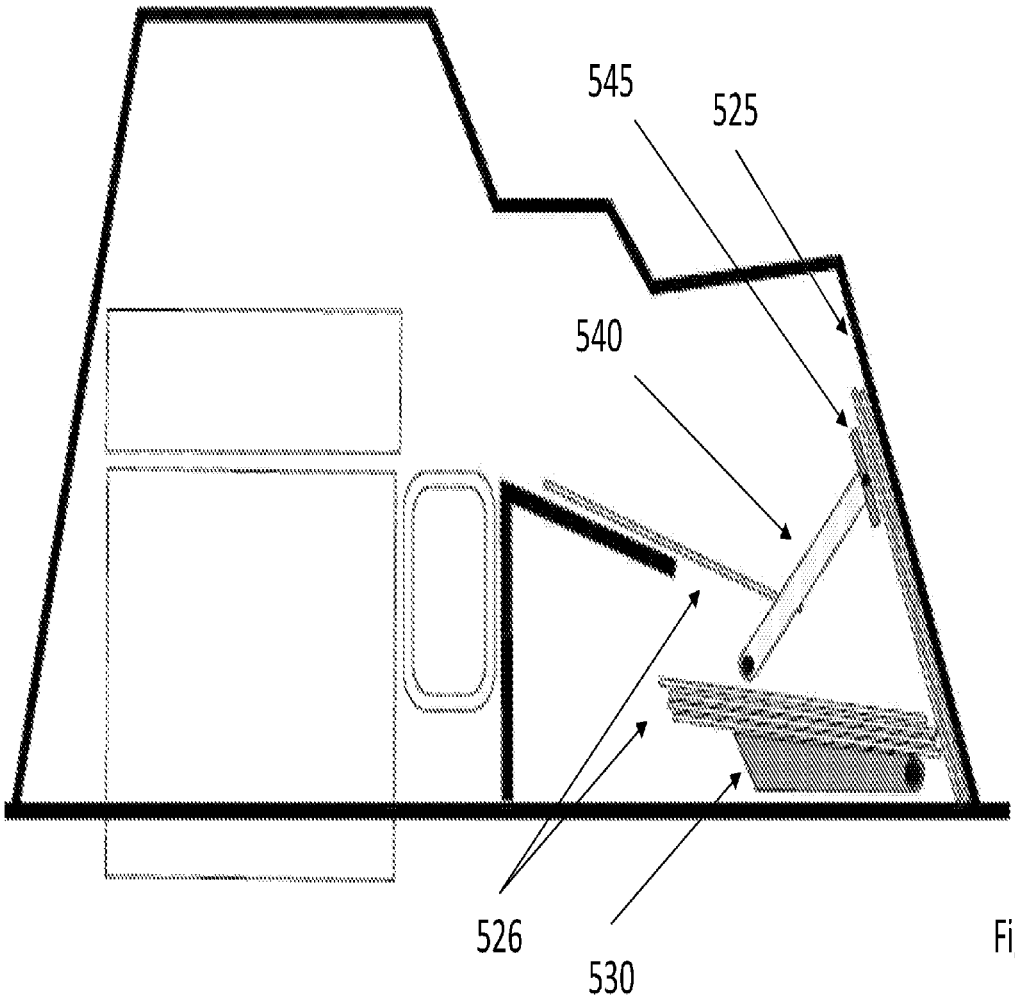
Figure 19G:
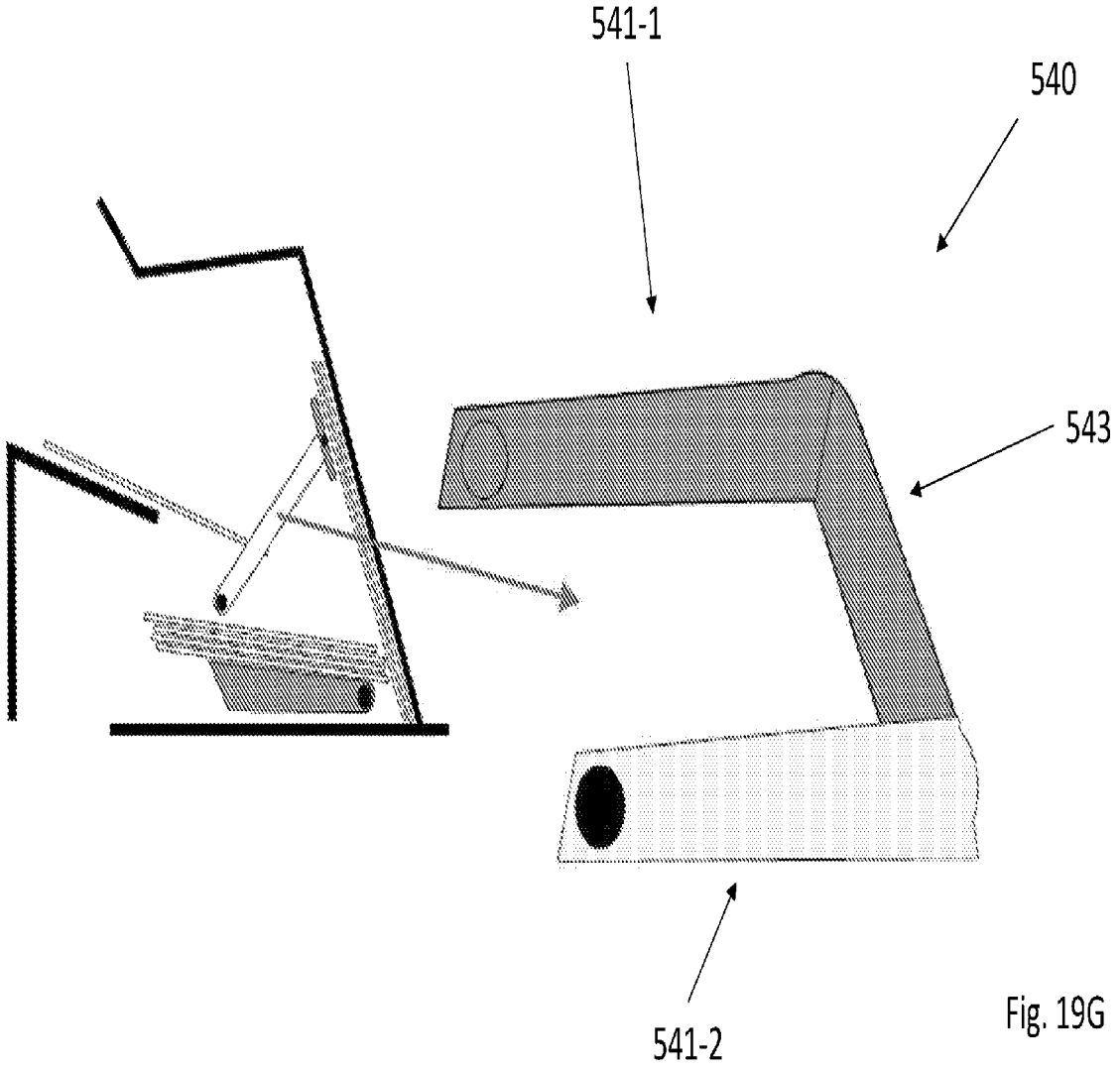

FIGS. 19A-19M show cross-sectional side views of a first embodiment of a Baccarat shuffler 500 having housing 505. The housing 505 includes an integral dealing shoe 510 providing access to the shuffled cards. From the sectional side view, only one shuffler device 515 is viewable as the second shuffler device is positioned behind. Card slides 520 (the other card slide is not visible as it is behind the visible card slide) direct the cards propelled by the two shuffler devices 515 into a common card-receiving area 525 and on to a card flipper 530. As best shown in FIGS. 19B and 19C, the card flipper 530 rotates roughly about one end thereof to force shuffled cards 535 in the card-receiving area 525 against a face plate 511 of integral dealing shoe 510. The card flipper 530 may be rotatably hinged to a bottom of the housing 505 or otherwise rotatably attached to the housing 505 (or other internal component) and serves as the floor of the card-receiving area 525. Responsive to sensor outputs, a stepper motor, servo or other electromechanical element drives the card flipper 530 to force the shuffled cards 535 against the face plate 511 and back to a home position in the card-receiving area 525 and the buffer-holder member 540 in a down position.

Figure 19H:
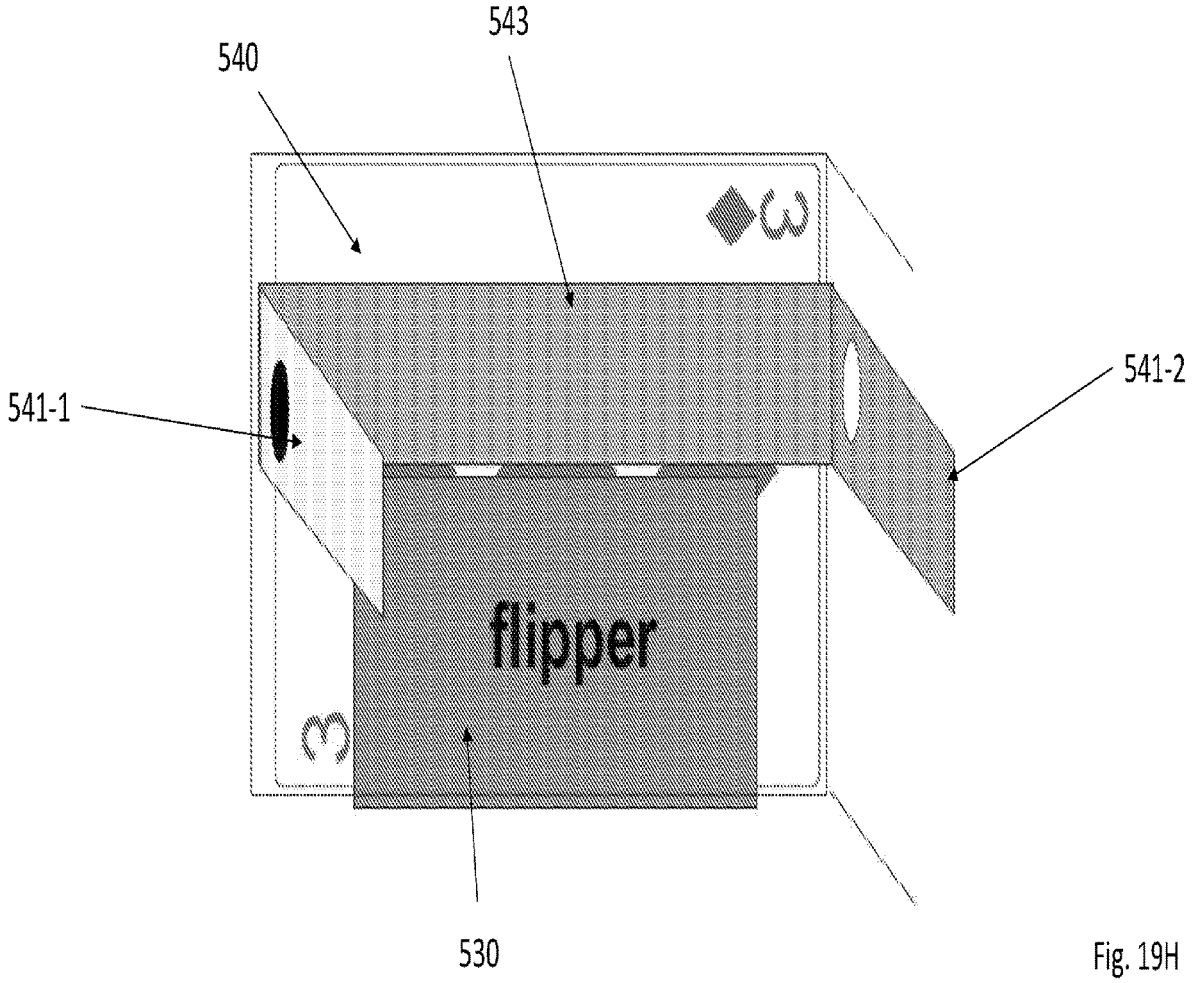
Figure 19I:
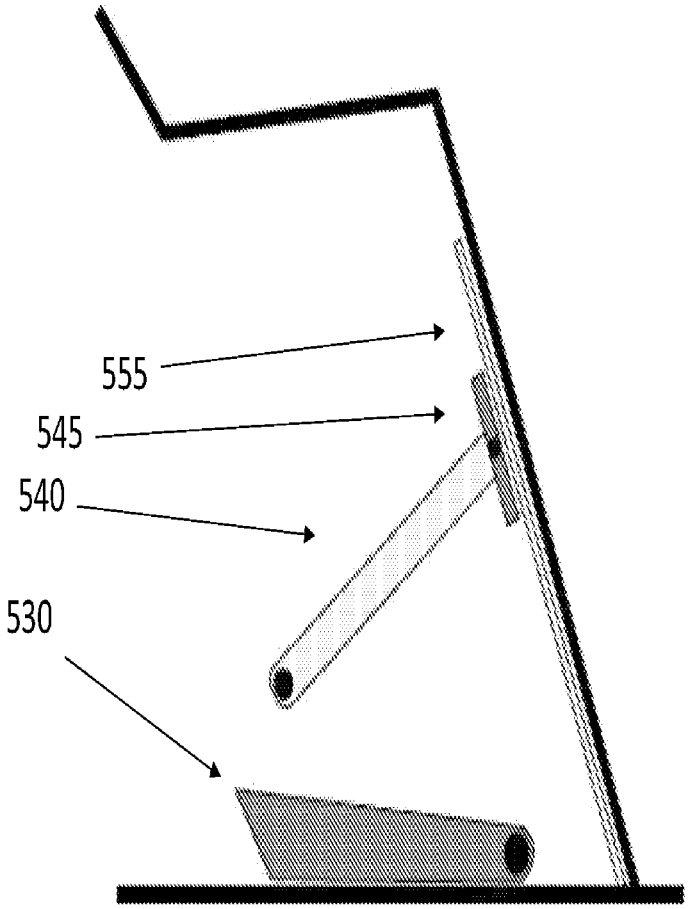
Figure 19J:
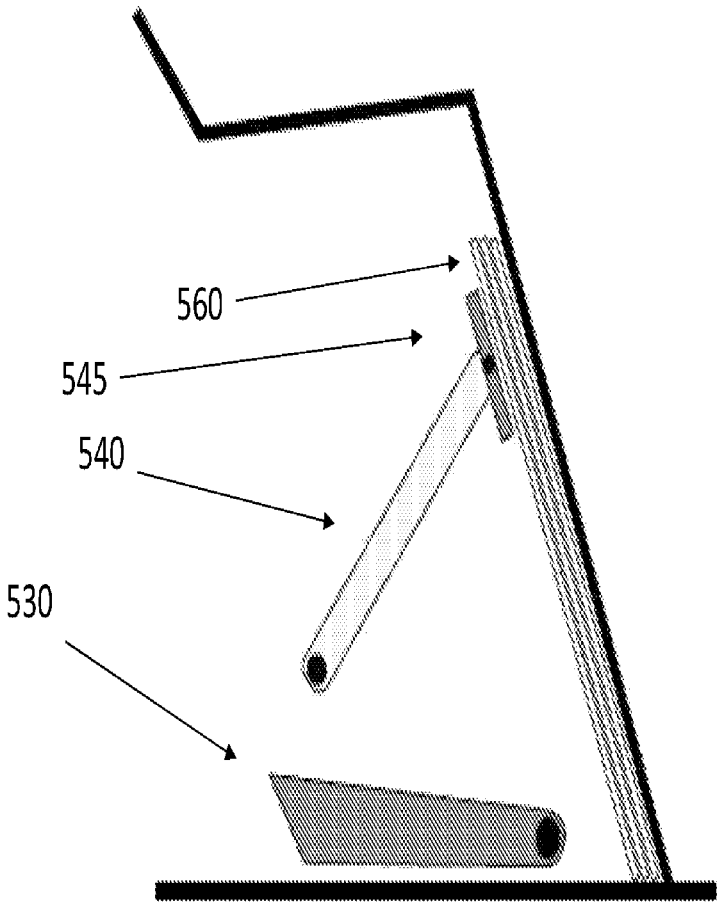
Figure 19L:
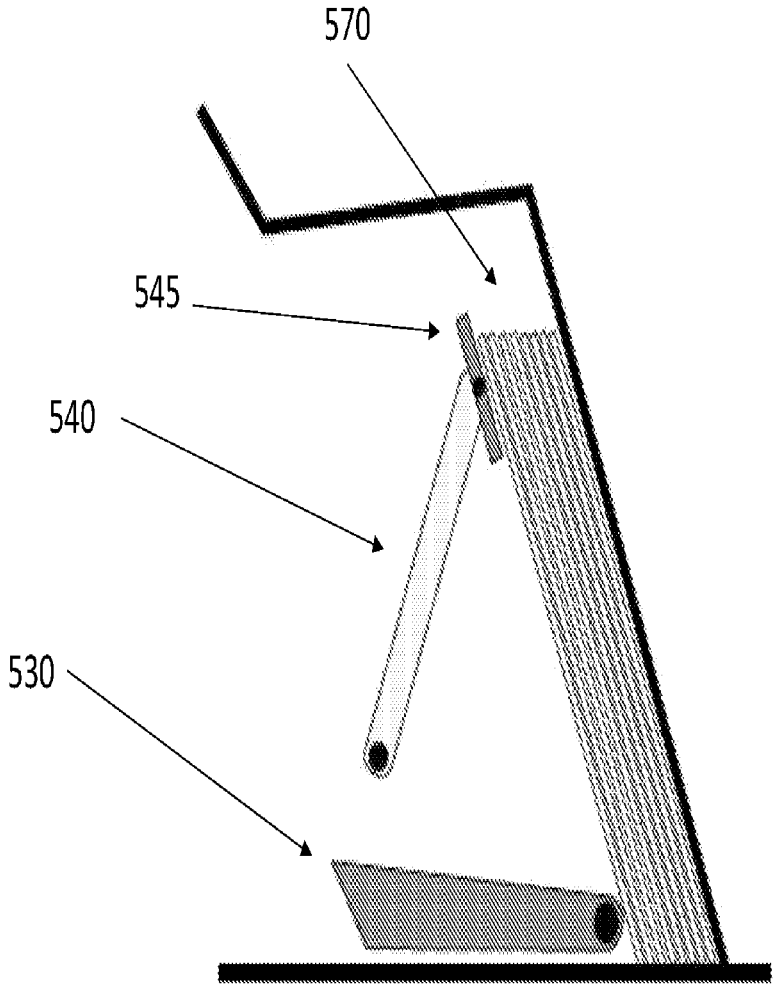
Figure 19M:
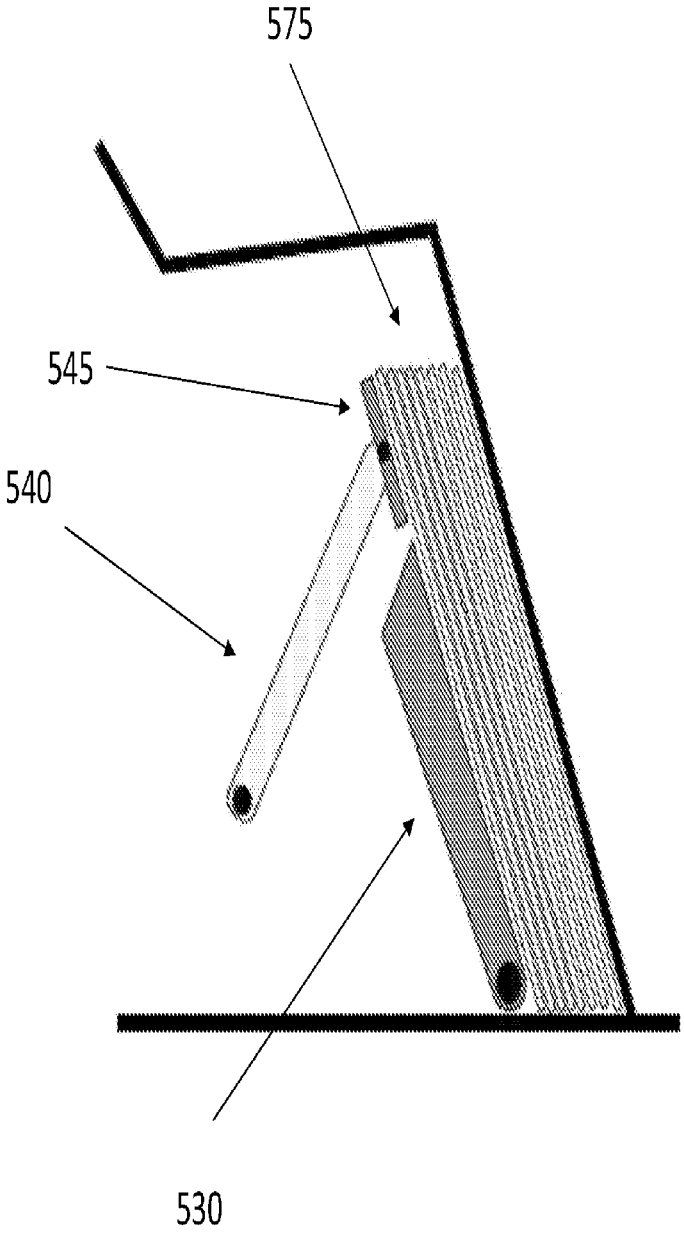

A buffer-holder member 540 is configured to maintain the shuffled cards 535 (a.k.a. buffer cards) against the face plate 511 once the card flipper 530 returns to the home position. Like the card flipper 530, the buffer-holder member 540 is rotatably attached to the housing 505 (or other internal component). In one embodiment, as best shown in 19G and 19H, the buffer-holder member 540 is U-shaped with two arms 541-1, 541-2 and a support 543 connecting the two arms 541-1, 541-2. A plate 545 may be attached to the support 543 to provide more contact area with the shuffled cards being maintained against the face plate 511. The plate 545 may have a soft covering to prevent damage to the buffer cards 535. Responsive to sensor outputs, a stepper motor, servo or other electromechanical element drives the buffer-holder member 540 to maintain the buffer cards 535 against the face plate 511 and back to a home position. FIGS. 19I through 19L show the buffer-holder member 540 maintaining a one-card buffer 555, three-card buffer 560, five-card buffer 565 and eight-card buffer 570. FIG. 19M shows an eight-card buffer 575 with the card flipper 530 in an upper position.

The buffer-holder member 540 and card flipper 530 operate in concert to move shuffled cards against the face plate 511 and maintain the shuffled cards against the face plate 511. Referring to FIGS. 19A through 19F show operation of the Baccarat shuffler 500. In FIG. 19A, cards have been randomly selected and propelled into the card-receiving area 525 on to the card flipper 530; in FIG. 19B, once eight cards have been propelled into the card-receiving area 525, the card flipper 530 begins rotating; in FIG. 19C, the card flipper 530 forces the eight cards against the face plate 511; in FIG. 19D, once the card flipper 530 has forced the cards against the face plate 511, the buffer-holder member 540 rotates into place against the eight buffer cards 535 (FIG. 19H shows another view of the buffer-holder member 540 against the buffer cards 535); in FIG. 19E, the card flipper 530 returns to a home position and the shuffler devices 515 begin randomly selecting and propelling cards 526 into the card-receiving area 525 and on to the card flipper 530; and in FIG. 19F, the card flipper 530 remains in the home position while the shuffler devices 515 continue randomly selecting and propelling cards into the card-receiving area 525 and on to the card flipper 530 while the buffer cards 535 are being dealt to players. The buffer-holder member 540 moves to a home position when the next group of cards is ready to be acted upon by the card flipper 530.

FIGS. 20A-20F show a cross-sectional side views of a second embodiment of a Baccarat shuffler 600 and housing 605 according to the embodiments of the present invention. The primary difference between Baccarat shuffler 500 and Baccarat shuffler 600 is the mechanism for maintaining the buffer cards against a face plate 625 of a dealing shoe 630. In this instance, an upper card stop 610 works in concert with lower card flipper 615. The lower card flipper 615 forces buffer cards 620 against the face plate 625 of the dealing shoe 630 and upper card stop 610 maintains the buffer cards 620 against the face plate 625 allowing the lower card flipper 615 to return to a home position for new shuffled cards. Card slides 635 (only one is visible) guide cards to the lower card flipper 615 when propelled from the shuffler devices 612 (only one is visible).

Figure 20A:
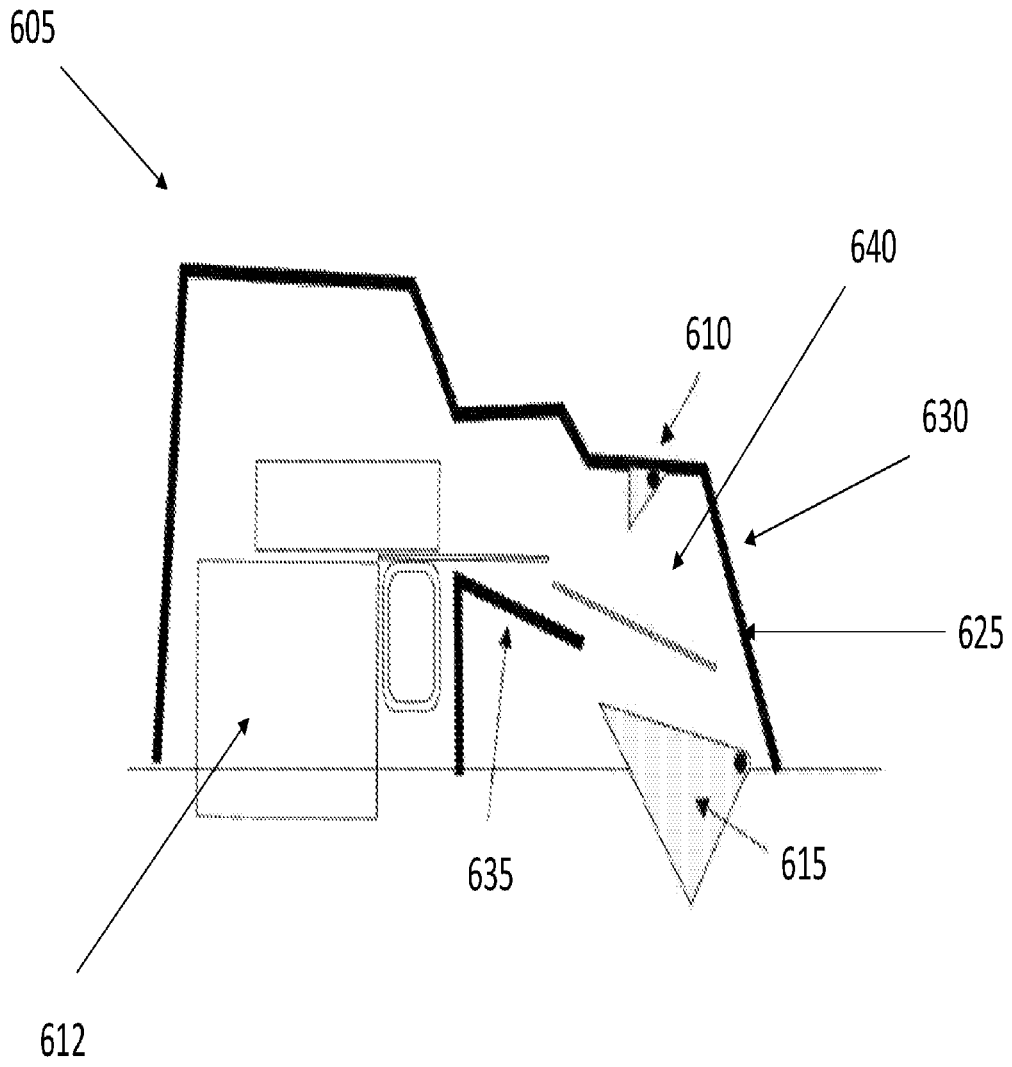
FIGS. 20A-20F illustrate a cross-sectional view of a second embodiment of a Baccarat shuffler and buffer apparatus according to the embodiments of the present invention.
Figure 20B:
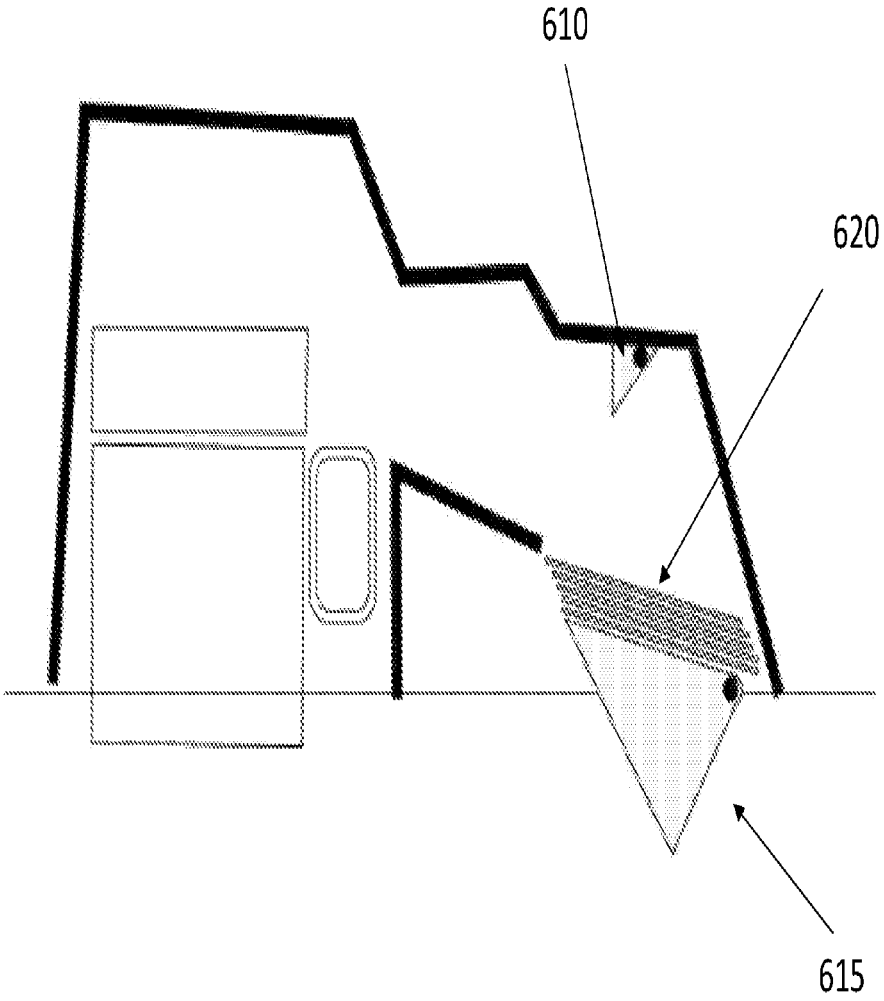
Figure 20C:
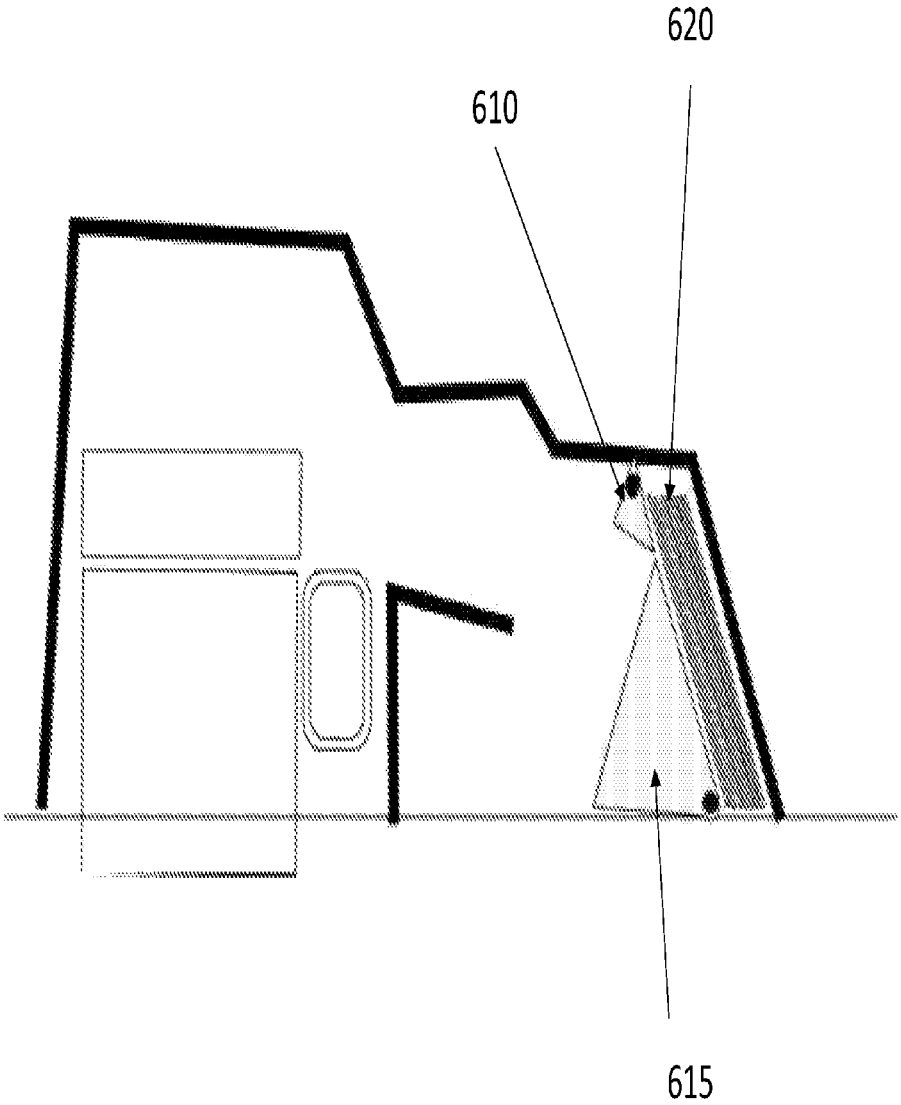
Figure 20D:
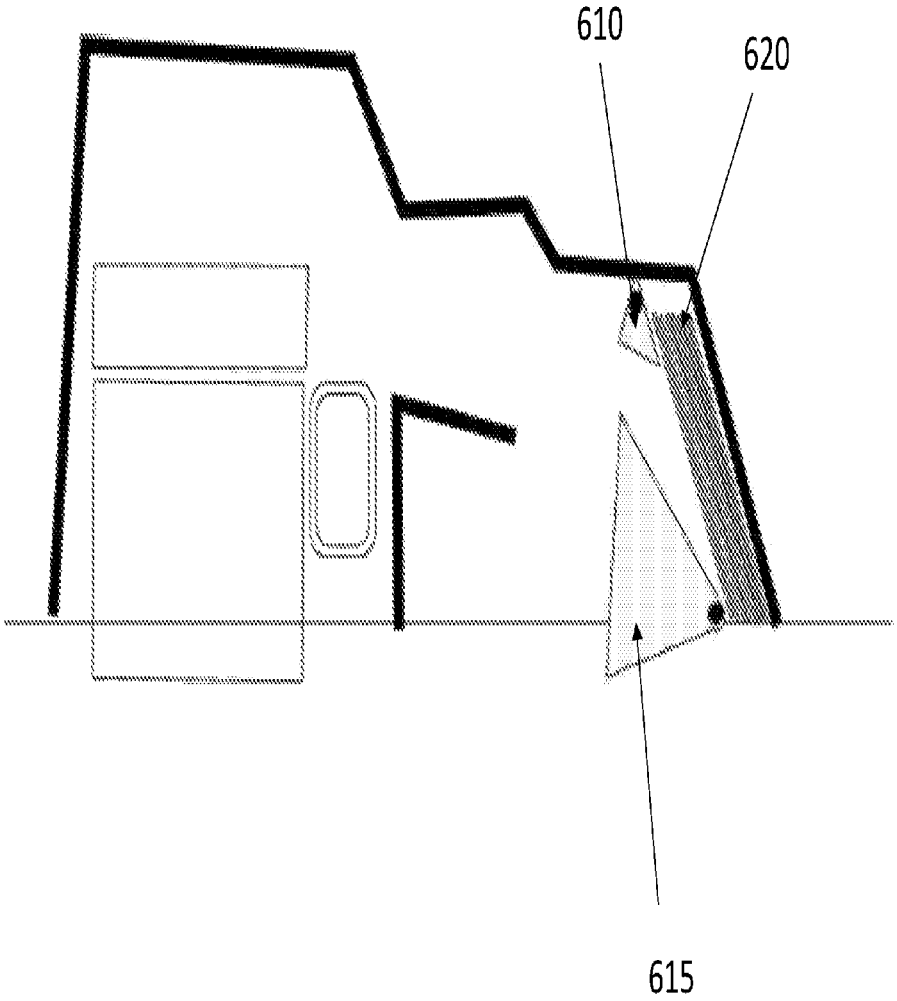
Figure 20E:
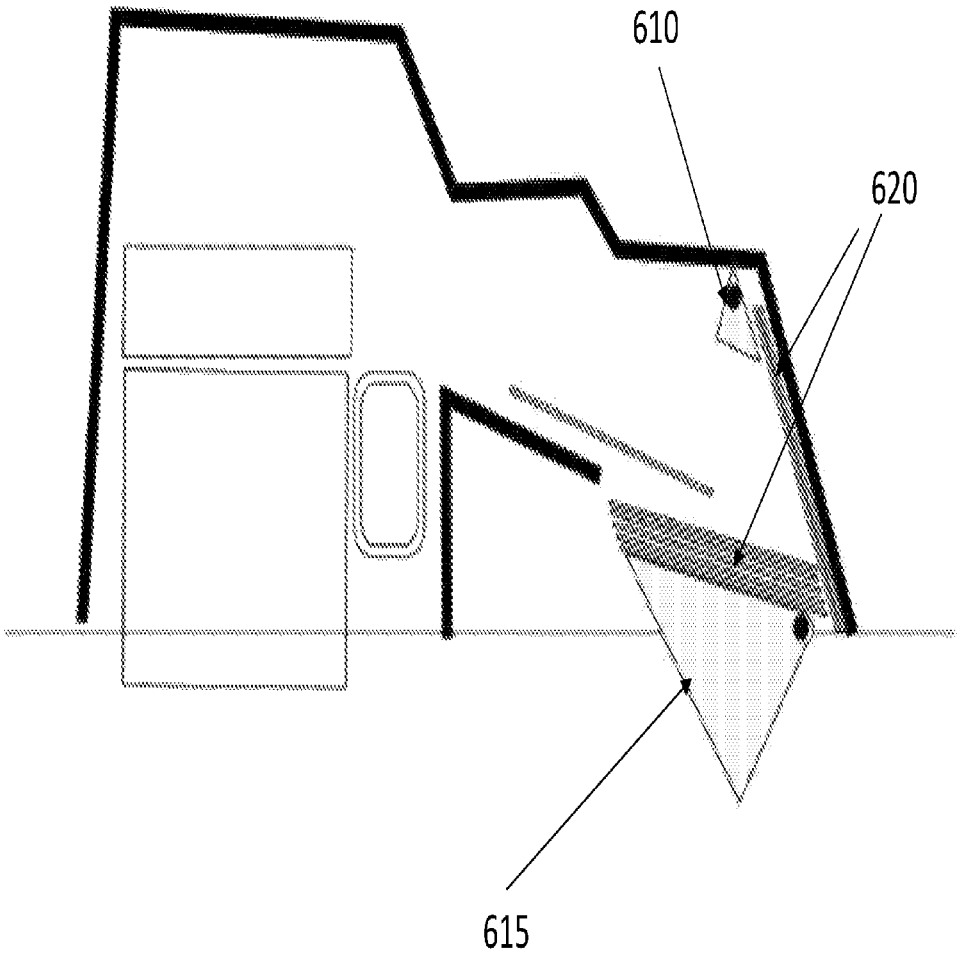
Figure 20F:
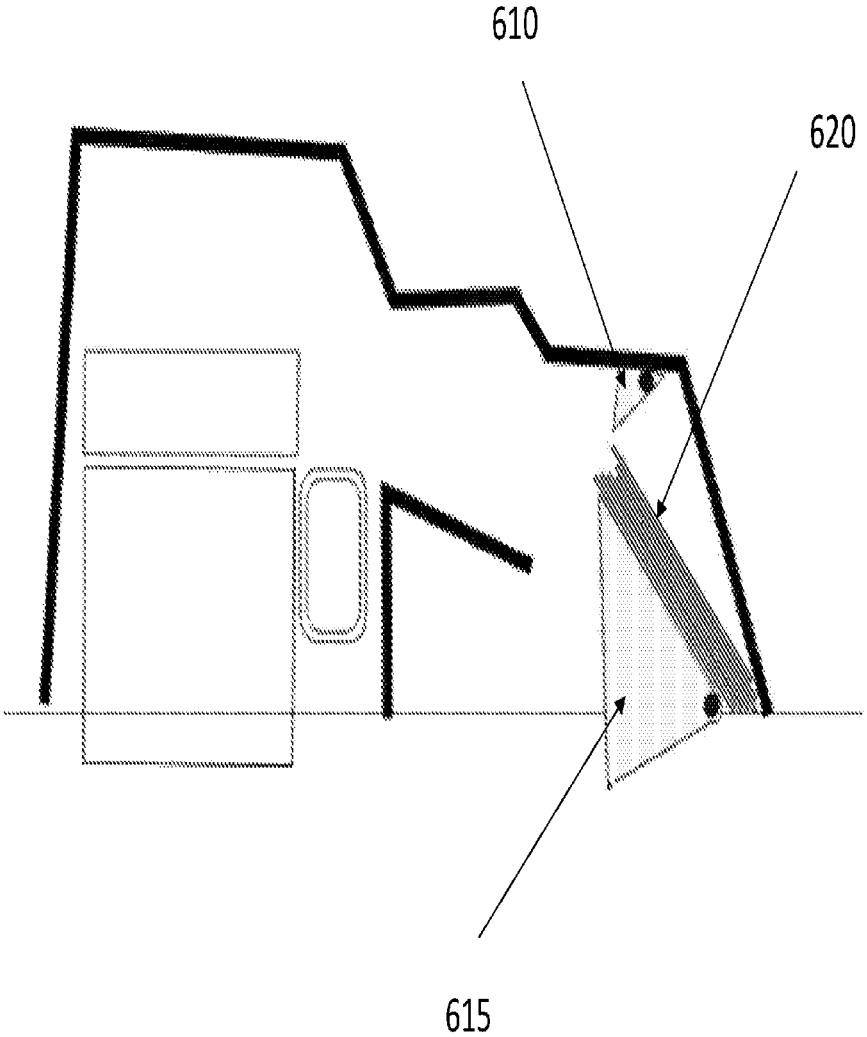

In FIG. 20A, cards have been randomly selected and propelled into the card-receiving area 630 and on to the lower card flipper 615; in FIG. 20B, once eight cards have been propelled into the card-receiving area 640, the lower card flipper 615 begins rotating; in FIG. 20C, the lower card flipper 615 forces the eight cards against the face plate 625; in FIG. 20D, once the lower card flipper 615 has forced the buffer cards 620 against the face plate 625, the upper card stop 610 rotates into place against the eight buffer cards 620; in FIG. 20E, the lower card flipper 615 returns to a home position and the shuffler devices begin randomly selecting and propelling cards into the card-receiving area 640 and on to the lower card flipper 615; and in FIG. 20F, the lower card flipper 615 remains in the home position while the shuffler devices continue randomly selecting and propelling cards into the card-receiving area 630 and on to the lower card flipper 615 while the buffer cards 620 are being dealt to players. The upper card stop 610 moves to a home position when the next group of cards is ready to be acted upon by the lower card flipper 615.

Sensors in or near the card-receiving area and integral dealing shoe provide the necessary outputs for controlling dealing operations, including movement of the card flipper 530 and buffer-holder member 540, of the Baccarat shufflers 500, 600. The sensors detect the number of cards propelled from the shuffler devices as well as number of cards removed from the dealing shoe. The collected sensor data or outputs is used by the processor to control the card flipper and buffer-holder member.

Figure 21:
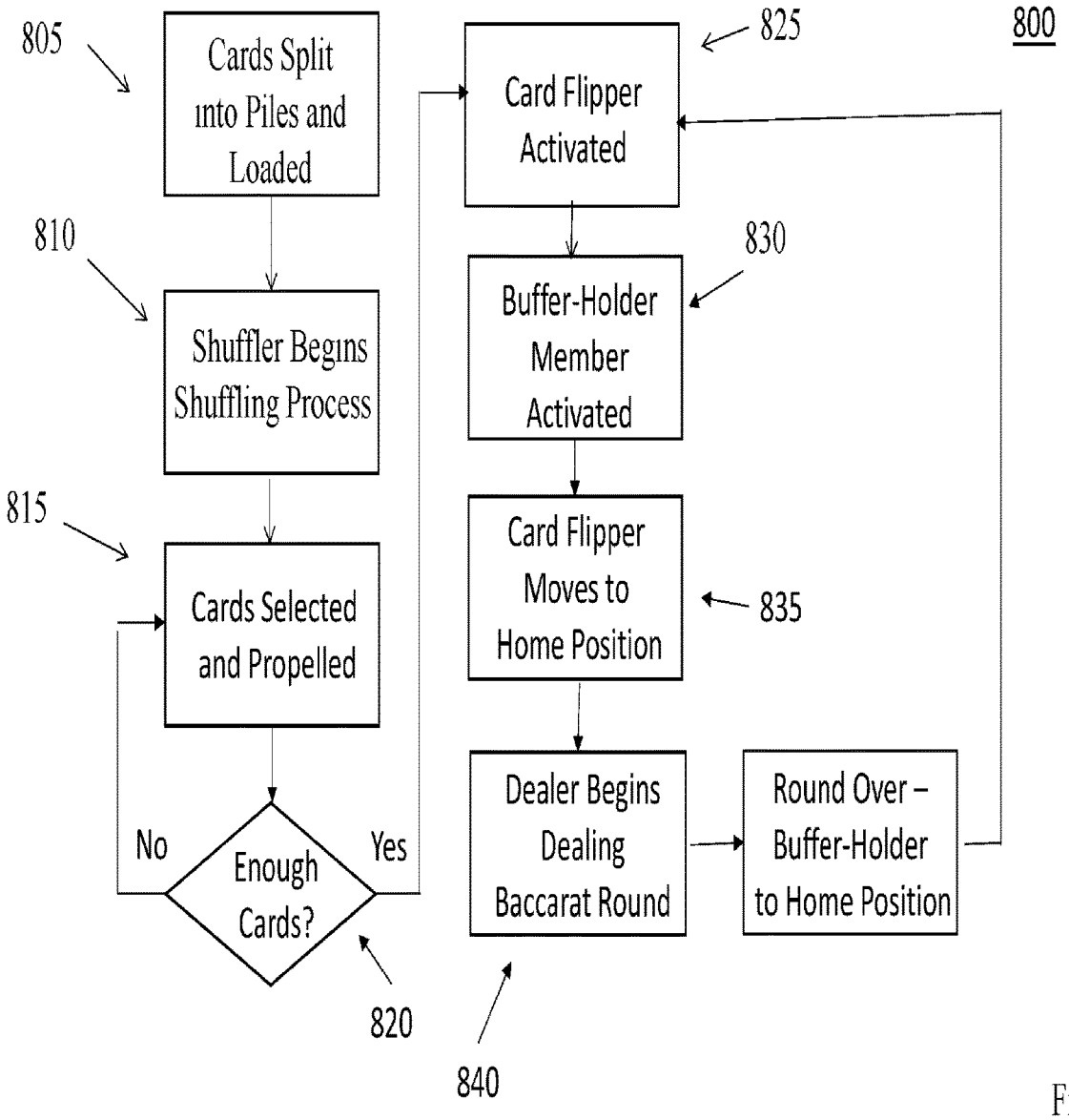
FIG. 21 illustrates a flow chart detailing operation of the Baccarat shuffler according to the embodiments of the present invention.

FIG. 21 shows a flow chart 800 detailing one methodology of operating a Baccarat shuffler according to the embodiments of the present invention. At 805, cards are split into two piles and loaded into the pre-shuffle bins of the two shuffler devices. At 810, the Baccarat shuffler is instructed to shuffle. At 815, the two shuffler devices randomly select cards and propel them toward the card slides and on to the card flipper in the card-receiving area. At 820, it is determined if a sufficient number of buffer cards (e.g., eight) have been propelled to the card flipper. If so, at 825, the card flipper activates to force the cards into the face plate of the integral dealing shoe. At 830, a buffer-holder member or similar mechanical device activates to maintain the buffer cards against the face plate of the dealing shoe. At 835, the card flipper moves to a home position and the flow chart 800 loops back to 815. At 840, the dealer begins dealing a round of Baccarat. At 845, the Baccarat round ends and the buffer-holder returns to a home position. The flow chart 800 loops back to 825 as cards have been propelled to the card-receiving area and on to the card flipper as the round was being dealt. This process allows the Baccarat game to proceed very quickly compared to other shufflers.

Figure 17A:
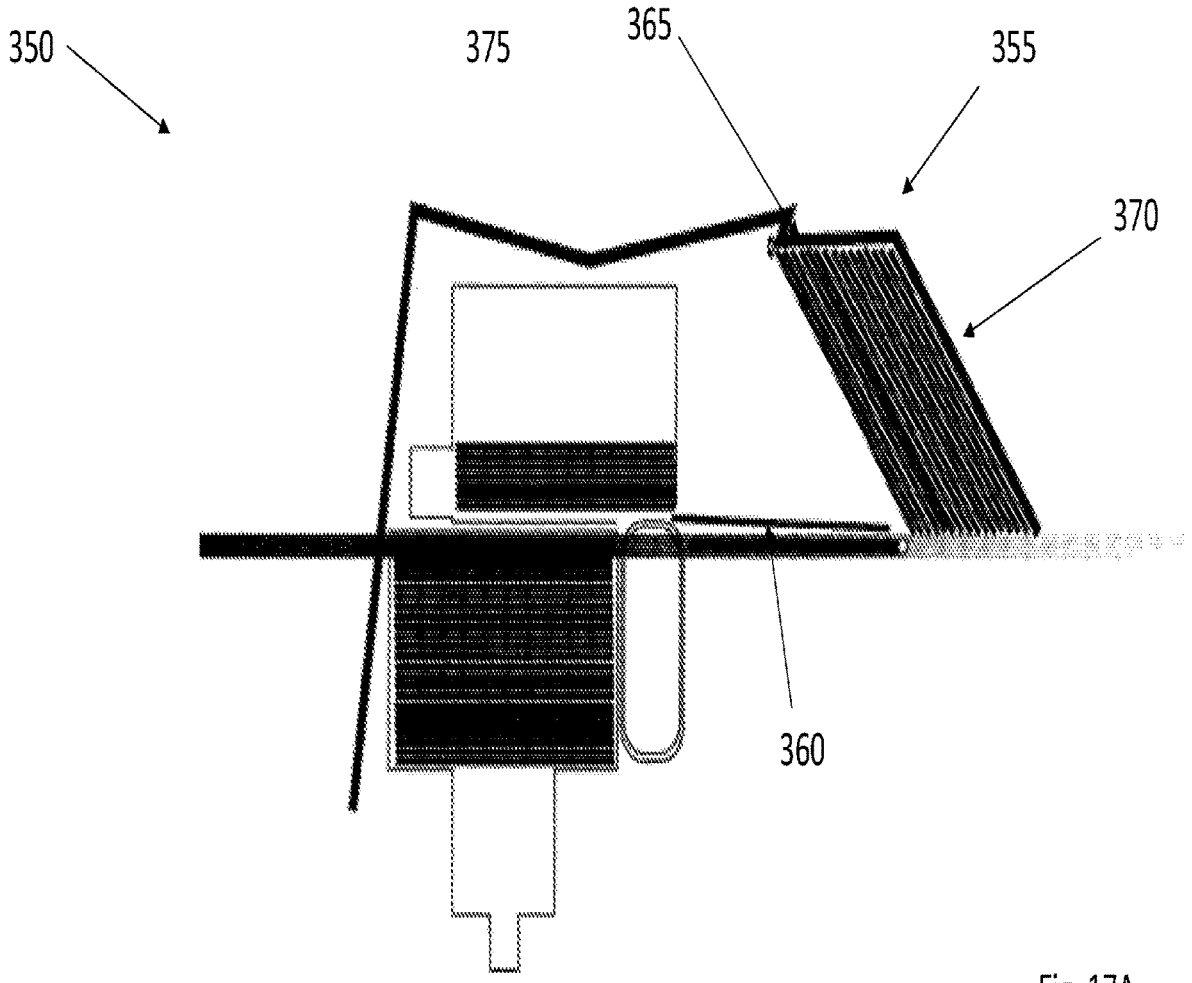
FIGS. 17A-17C illustrate a continuous shuffler according to the embodiments of the present invention.
Figure 17B:
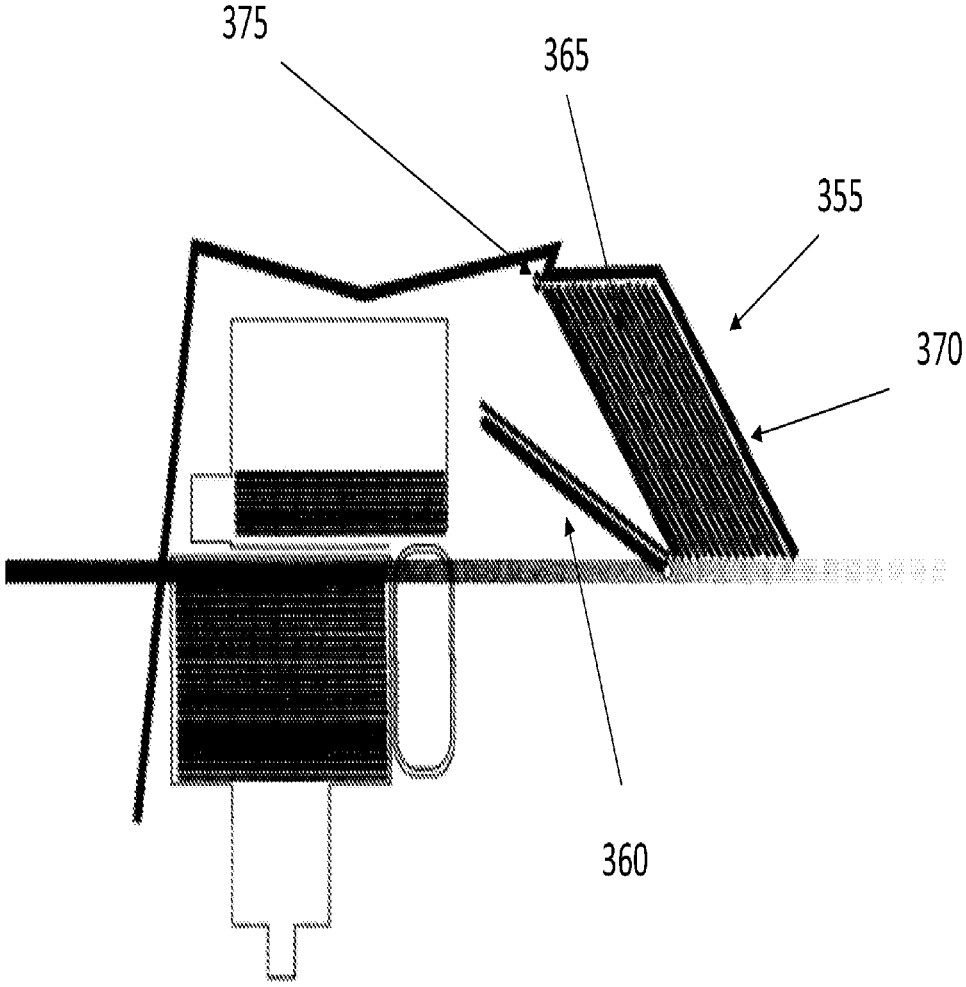
Figure 17C:
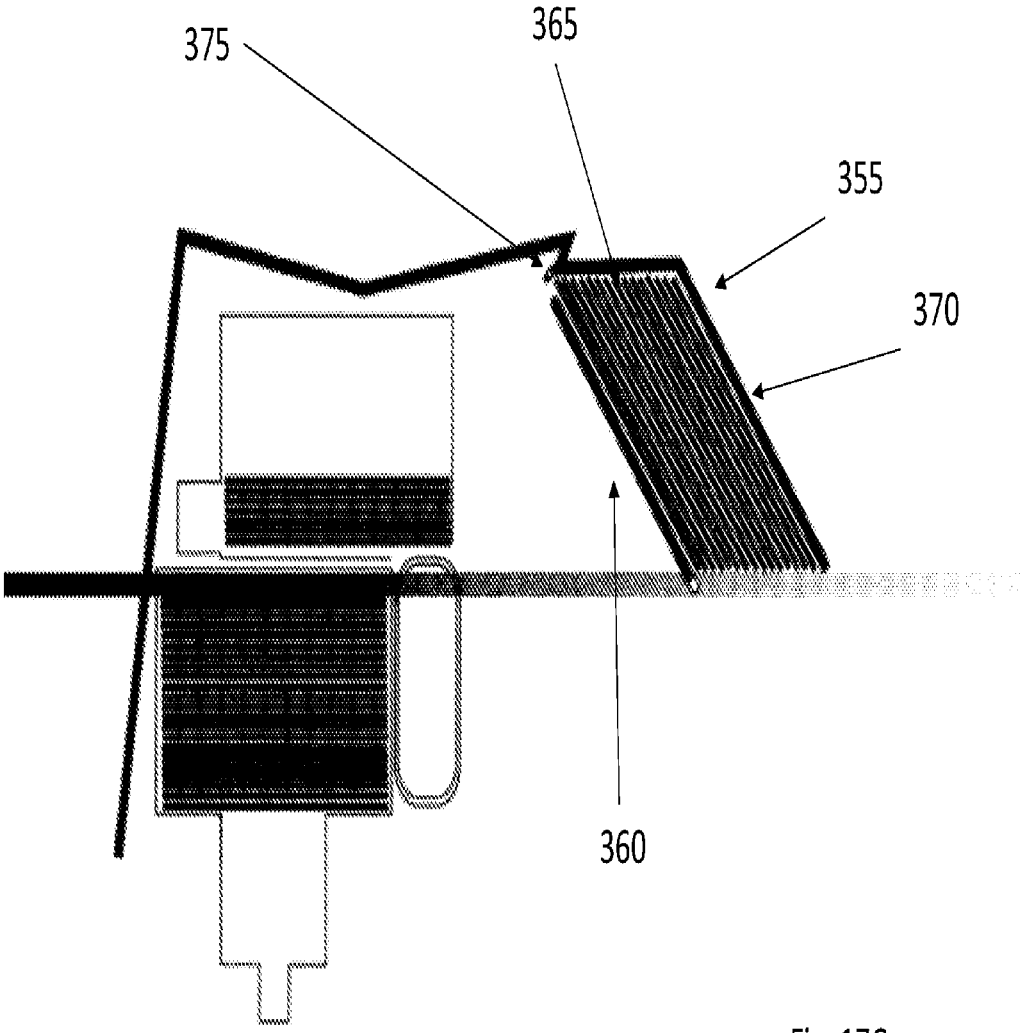

In another embodiment, the shuffler technology is used in a continuous shuffler 350 as shown in FIGS. 17A-17C. For example, in a six-deck dealing shoe, starting the continuous process comprises the random number generator selects a position from 1-312 and moves the corresponding card forward to the front of a dealing shoe 355 and then selects a card from 1-311 and moves the corresponding card forward to the front of the dealing shoe 355 and so on. After are-established number of cards (e.g., 13) have been moved forward in the dealing shoe 355, discards can be placed into a pre-shuffle bin with the remaining cards. A lever (or flipper) 360 is configured to lift randomly-selected cards 365 against a dealing shoe face plate 370 for dealer access. A clip 375 or other mechanism may hold the cards 365 against the face plate 370 while the lever 360 drops back down to a horizontal position to receive more cards. This process can continue indefinitely resulting in continuous shuffled group of cards in the dealing shoe 355.

Although the invention has been described in detail with reference to several embodiments, additional variations and modifications exist within the scope and spirit of the invention as described and defined in the following claims.

We claim:

1. An automatic card shuffler comprising:

a processor running executable instructions;

a pre-shuffle bin having a base, said pre-shuffle bin configured to receive one or more decks of cards;

a device configured, responsive to instructions of said processor, to raise and lower said base and said one or more decks of cards into position relative to a card-selector assembly;

said card-selector assembly having an upper body and stationary lower body, said upper body movable horizontally relative to said stationary lower body, said card-selector assembly configured, responsive to instructions of said processor, to separate said one or more decks of cards into an upper group of cards and an offset lower group of cards such that a bottom card of said upper group of cards is exposed; and a drive mechanism positioned proximate to said upper body to remove, responsive to instructions of said processor, said bottom card from said upper group of cards.

2. The automatic card shuffler of claim 1 wherein said card-selector assembly is configured to cease once a pre-established number of cards, forming a game hand, are removed from said upper group of cards by said card-selector assembly.

3. The automatic card shuffler of claim 2 further comprising a pusher mechanism configured to push said game hand from said automatic card shuffler to a position on a game table accessible by a dealer.

4. The automatic card shuffler of claim 2 further comprising one or more sensors configured to identify when a game hand has been removed by a dealer and cause card-selector assembly to activate.

5. The automatic card shuffler of claim 1 further comprising a wall positioned to cause said cards moved by said drive mechanism to stack into a game hand.

6. The automatic card shuffler of claim 1 further comprising an offset idler roller configured to move said upper body relative to said stationary lower body.

7. The automatic card shuffler of claim 1 wherein said drive mechanism successively moves all cards forming said one or more decks of cards from said pre-shuffle bin.

8. The automatic card shuffler of method of claim 1 wherein said drive mechanism moves a pre-established number of cards, forming a game hand, from said one or more decks of cards from said pre-shuffle bin.

9. An automatic card shuffler comprising:

a processor running executable instructions;

a first pre-shuffle bin having a first base, said first pre-shuffle bin configured to receive a first one or more decks of cards;

a second pre-shuffle bin having a second base, said second pre-shuffle bin configured to receive a second one or more decks of cards;

a first device and second device configured to, responsive to instructions of said processor, raise and lower said first base and said second base, respectively, into position relative to a first and second card-selector assembly, respectively;

a first card-selector assembly having a first upper body and first stationary lower body, said first upper body movable horizontally relative to said first stationary lower body, said first card-selector assembly configured to, responsive to instructions of said processor, separate said first one or more decks of cards into a first upper group of cards and a first offset lower group of cards such that a bottom card of said first upper group of cards is exposed;

a second card-selector assembly having a second upper body and second stationary lower body, said second upper body movable horizontally relative to said second stationary lower body, said second card-selector assembly configured to, responsive to instructions of said processor, separate said second one or more decks of cards into a second upper group of cards and a second offset lower group of cards such that a bottom card of said second upper group of cards is exposed; and a first drive mechanism positioned proximate to said first upper body to remove, responsive to instructions of said processor, said bottom card from said first upper group of cards; and a second drive mechanism positioned proximate to said second upper body to remove responsive to instructions of said processor, said bottom card from said second upper group of cards.

10. The automatic card shuffler of claim 9 further including a post shuffle bin into which said first drive mechanism and said second drive mechanism move said bottom card from said first upper group of cards and said bottom card from said second upper group of cards, respectively.

11. The automatic card shuffler of claim 9 wherein said first and second card-selector assemblies are configured to cease once a pre-established number of cards, forming a game hand, are removed from said first and second upper group of cards by said first and second card-selector assemblies.

12. The automatic card shuffler of claim 11 further comprising a pusher mechanism configured to push said game hand from said automatic card shuffler to a position on a game table accessible by a dealer.

13. The automatic card shuffler of claim 12 further comprising one or more sensors configured to identify when a game hand has been removed by a dealer and cause said first and second card-selector assemblies to activate.

14. A method of shuffling cards comprising:

configuring an automatic card shuffler, said automatic card shuffler having a processor running executable instructions for:

(i) receiving one or more decks of cards into a pre-shuffle bin having a base, upper body and lower body;

(ii) vertically moving said base via a motor pursuant to instructions from said processor;

(iii) via said motor pursuant to instructions from said processor moving said upper body horizontally relative to said lower body to separate said one or more decks of cards into an upper group of cards and offset lower group of cards whereby a bottom card of said upper group of cards is exposed; and (iv) using a drive wheel pursuant to instructions from said processor for removing said bottom card from said upper group of cards.

15. The method of claim 14 further comprising: (v) repeating steps (ii) to (iv) until all cards forming said one or more decks of cards have been moved from said pre-shuffle bin.

16. The method of claim 14 further comprising: (v) repeating steps (ii) to (iv) until a pre-established number of cards, forming a game hand, from said one or more decks of cards have been moved from said pre-shuffle bin.

17. The method of claim 16 further comprising pushing said game hand from said automatic card shuffler to a position on a game table accessible by a dealer.

18. The method of claim 17 further comprising sensing when a game hand has been removed by a dealer.

* * * * *